US007770822B2

(12) United States Patent
Leber

(10) Patent No.: US 7,770,822 B2
(45) Date of Patent: Aug. 10, 2010

(54) HAND SHOWER WITH AN EXTENDABLE HANDLE

(75) Inventor: Leland C. Leber, Fort Collins, CO (US)

(73) Assignee: Water Pik, Inc., Fort Collins, CO (US)

( * ) Notice: Subject to any disclaimer, the term of this patent is extended or adjusted under 35 U.S.C. 154(b) by 0 days.

(21) Appl. No.: 11/965,223

(22) Filed: Dec. 27, 2007

(65) Prior Publication Data

US 2008/0156903 A1 Jul. 3, 2008

Related U.S. Application Data

(60) Provisional application No. 60/882,414, filed on Dec. 28, 2006.

(51) Int. Cl.
*B05B 9/08* (2006.01)

(52) U.S. Cl. ..... 239/530; 239/280; 239/281; 239/525; 239/587.1; 239/588; 239/600; 285/145.1; 285/302

(58) Field of Classification Search ..... 239/280, 239/280.5, 281, 525, 530, 532, 587.1, 588, 239/600; 285/144.1, 145.1, 145.4, 298, 302, 285/303

See application file for complete search history.

(56) References Cited

U.S. PATENT DOCUMENTS

| | | | |
|---|---|---|---|
| 203,094 | A | 4/1878 | Wakeman |
| 204,333 | A | 5/1878 | Josias |
| 309,349 | A | 12/1884 | Hart |
| 428,023 | A | 5/1890 | Schoff |
| 432,712 | A | 7/1890 | Taylor |
| 445,250 | A | 1/1891 | Lawless |
| 486,986 | A | 11/1892 | Schinke |
| 566,384 | A | 8/1896 | Engelhart |
| 566,410 | A | 8/1896 | Schinke |

(Continued)

FOREIGN PATENT DOCUMENTS

| | | |
|---|---|---|
| CA | 659510 | 3/1963 |

(Continued)

OTHER PUBLICATIONS

Color Copy, Labeled 1A, Gemlo, available at least as early as Dec. 2, 1998.

(Continued)

*Primary Examiner*—Steven J Ganey
(74) *Attorney, Agent, or Firm*—Dorsey & Whitney LLP

(57) ABSTRACT

A handheld shower assembly is provided. The handheld shower assembly includes a water conduit, a handle, and a showerhead. The water conduit is adapted to attach to the showerhead at one end and to a water source extending from a wall of a shower stall at another end to receive water flow. The handle includes a first portion and a second portion adapted to accept the water conduit within an interior portion of the handle. The first portion is adjustably coupled to the second portion. This allows the first portion to telescope with respect to the second portion, thereby the first portion extends from a first retracted position to a second extended position. The showerhead is coupled to the water conduit and the handle. The showerhead may receive the water flow from the water conduit as well as expelling the water flow.

16 Claims, 11 Drawing Sheets

U.S. PATENT DOCUMENTS

| | | | |
|---|---|---|---|
| 570,405 | A | 10/1896 | Jerguson et al. |
| 694,888 | A | 3/1902 | Pfluger |
| 800,802 | A | 10/1905 | Franquist |
| 832,523 | A | 10/1906 | Andersson |
| 835,678 | A | 11/1906 | Hammond |
| 854,094 | A | 5/1907 | Klein |
| 926,929 | A | 7/1909 | Dusseau |
| 1,001,842 | A | 8/1911 | Greenfield |
| 1,003,037 | A | 9/1911 | Crowe |
| 1,018,143 | A | 2/1912 | Vissering |
| 1,046,573 | A | 12/1912 | Ellis |
| 1,203,466 | A | 10/1916 | Benson |
| 1,217,254 | A | 2/1917 | Winslow |
| 1,218,895 | A | 3/1917 | Porter |
| 1,255,577 | A | 2/1918 | Berry |
| 1,260,181 | A | 3/1918 | Garnero |
| 1,276,117 | A | 8/1918 | Riebe |
| 1,284,099 | A | 11/1918 | Harris |
| 1,327,428 | A | 1/1920 | Gregory |
| 1,451,800 | A | 4/1923 | Agner |
| 1,459,582 | A | 6/1923 | Dubee |
| 1,469,528 | A | 10/1923 | Owens |
| 1,500,921 | A | 7/1924 | Bramson et al. |
| 1,560,789 | A | 11/1925 | Johnson et al. |
| 1,597,477 | A | 8/1926 | Panhorst |
| 1,633,531 | A | 6/1927 | Keller |
| 1,692,394 | A | 11/1928 | Sundh |
| 1,695,263 | A | 12/1928 | Jacques |
| 1,724,147 | A | 8/1929 | Russell |
| 1,724,161 | A | 8/1929 | Wuesthoff |
| 1,736,160 | A | 11/1929 | Jonsson |
| 1,754,127 | A | 4/1930 | Srulowitz |
| 1,758,115 | A | 5/1930 | Kelly |
| 1,778,658 | A | 10/1930 | Baker |
| 1,821,274 | A | 9/1931 | Plummer |
| 1,849,517 | A | 3/1932 | Fraser |
| 1,890,156 | A | 12/1932 | Konig |
| 1,906,575 | A | 5/1933 | Goeriz |
| 1,934,553 | A | 11/1933 | Mueller et al. |
| 1,946,207 | A | 2/1934 | Haire |
| 2,011,446 | A | 8/1935 | Judell |
| 2,024,930 | A | 12/1935 | Judell |
| 2,033,467 | A | 3/1936 | Groeniger |
| 2,044,445 | A | 6/1936 | Price et al. |
| 2,085,854 | A | 7/1937 | Hathaway et al. |
| 2,096,912 | A | 10/1937 | Morris |
| 2,117,152 | A | 5/1938 | Crosti |
| D113,439 | S | 2/1939 | Reinecke |
| 2,196,783 | A | 4/1940 | Shook |
| 2,197,667 | A | 4/1940 | Shook |
| 2,216,149 | A | 10/1940 | Weiss |
| D126,433 | S | 4/1941 | Enthof |
| 2,251,192 | A | 7/1941 | Krumsiek et al. |
| 2,268,263 | A | 12/1941 | Newell et al. |
| 2,285,831 | A | 6/1942 | Pennypacker |
| 2,342,757 | A | 2/1944 | Roser |
| 2,402,741 | A | 6/1946 | Draviner |
| D147,258 | S | 8/1947 | Becker |
| D152,584 | S | 2/1949 | Becker |
| 2,467,954 | A | 4/1949 | Becker |
| 2,546,348 | A | 3/1951 | Schuman |
| 2,567,642 | A | 9/1951 | Penshaw |
| 2,581,129 | A | 1/1952 | Muldoon |
| D166,073 | S | 3/1952 | Dunkelberger |
| 2,648,762 | A | 8/1953 | Dunkelberger |
| 2,664,271 | A | 12/1953 | Arutunoff |
| 2,671,693 | A | 3/1954 | Hyser et al. |
| 2,676,806 | A | 4/1954 | Bachman |
| 2,679,575 | A | 5/1954 | Haberstump |
| 2,680,358 | A | 6/1954 | Zublin |
| 2,726,120 | A | 12/1955 | Bletcher et al. |
| 2,759,765 | A | 8/1956 | Pawley |
| 2,776,168 | A | 1/1957 | Schweda |
| 2,792,847 | A | 5/1957 | Spencer |
| 2,873,999 | A | 2/1959 | Webb |
| 2,930,505 | A | 3/1960 | Meyer |
| 2,931,672 | A | 4/1960 | Merritt et al. |
| 2,935,265 | A | 5/1960 | Richter |
| 2,949,242 | A | 8/1960 | Blumberg et al. |
| 2,957,587 | A | 10/1960 | Tobin |
| 2,966,311 | A | 12/1960 | Davis |
| D190,295 | S | 5/1961 | Becker |
| 2,992,437 | A | 7/1961 | Nelson et al. |
| 3,007,648 | A | 11/1961 | Fraser |
| D192,935 | S | 5/1962 | Becker |
| 3,032,357 | A | 5/1962 | Shames et al. |
| 3,034,809 | A | 5/1962 | Greenberg |
| 3,037,799 | A | 6/1962 | Mulac |
| 3,081,339 | A | 3/1963 | Green et al. |
| 3,092,333 | A | 6/1963 | Gaiotto |
| 3,098,508 | A | 7/1963 | Gerdes |
| 3,103,723 | A | 9/1963 | Becker |
| 3,104,815 | A | 9/1963 | Schultz |
| 3,104,827 | A | 9/1963 | Aghnides |
| 3,111,277 | A | 11/1963 | Grimsley |
| 3,112,073 | A | 11/1963 | Larson et al. |
| 3,143,857 | A | 8/1964 | Eaton |
| 3,196,463 | A | 7/1965 | Farneth |
| 3,231,200 | A | 1/1966 | Heald |
| 3,236,545 | A | 2/1966 | Parkes et al. |
| 3,239,152 | A | 3/1966 | Bachli et al. |
| 3,266,059 | A | 8/1966 | Stelle |
| 3,272,437 | A | 9/1966 | Coson |
| 3,273,359 | A | 9/1966 | Fregeolle |
| 3,306,634 | A | 2/1967 | Groves et al. |
| 3,323,148 | A | 6/1967 | Burnon |
| 3,329,967 | A | 7/1967 | Martinez et al. |
| 3,341,132 | A | 9/1967 | Parkison |
| 3,342,419 | A | 9/1967 | Weese |
| 3,344,994 | A | 10/1967 | Fife |
| 3,363,842 | A | 1/1968 | Burns |
| 3,383,051 | A | 5/1968 | Fiorentino |
| 3,389,925 | A | 6/1968 | Gottschald |
| 3,393,311 | A | 7/1968 | Dahl |
| 3,393,312 | A | 7/1968 | Dahl |
| 3,404,410 | A | 10/1968 | Sumida |
| 3,492,029 | A | 1/1970 | French et al. |
| 3,516,611 | A | 6/1970 | Piggott |
| 3,546,961 | A | 12/1970 | Marton |
| 3,550,863 | A | 12/1970 | McDermott |
| 3,552,436 | A | 1/1971 | Stewart |
| 3,565,116 | A | 2/1971 | Gabin |
| 3,566,917 | A | 3/1971 | White |
| 3,580,513 | A | 5/1971 | Martin |
| 3,584,822 | A | 6/1971 | Oram |
| 3,596,835 | A | 8/1971 | Smith et al. |
| 3,612,577 | A | 10/1971 | Pope |
| 3,637,143 | A * | 1/1972 | Shames et al. ..... 239/588 |
| 3,641,333 | A | 2/1972 | Gendron |
| 3,647,144 | A | 3/1972 | Parkison et al. |
| 3,663,044 | A | 5/1972 | Contreras et al. |
| 3,669,470 | A | 6/1972 | Deurloo |
| 3,672,648 | A | 6/1972 | Price |
| 3,682,392 | A | 8/1972 | Kint |
| 3,685,745 | A | 8/1972 | Peschcke-koedt |
| D224,834 | S | 9/1972 | Laudell |
| 3,711,029 | A | 1/1973 | Bartlett |
| 3,722,798 | A | 3/1973 | Bletcher et al. |
| 3,722,799 | A | 3/1973 | Rauh |
| 3,731,084 | A | 5/1973 | Trevorrow |
| 3,754,779 | A | 8/1973 | Peress |
| D228,622 | S | 10/1973 | Juhlin |
| 3,762,648 | A | 10/1973 | Deines et al. |
| 3,768,735 | A | 10/1973 | Ward |

3,786,995 A 1/1974 Manoogian et al.
3,801,019 A 4/1974 Trenary et al.
3,810,580 A 5/1974 Rauh
3,826,454 A 7/1974 Zieger
3,840,734 A 10/1974 Oram
3,845,291 A 10/1974 Portyrata
3,860,271 A 1/1975 Rodgers
3,861,719 A 1/1975 Hand
3,865,310 A 2/1975 Elkins et al.
3,869,151 A 3/1975 Fletcher et al.
3,896,845 A 7/1975 Parker
3,902,671 A 9/1975 Symmons
3,910,277 A 10/1975 Zimmer
D237,708 S 11/1975 Grohe
3,929,164 A 12/1975 Richter
3,958,756 A 5/1976 Trenary et al.
D240,322 S 6/1976 Staub
3,967,783 A 7/1976 Halsted et al.
3,979,096 A 9/1976 Zieger
3,997,116 A 12/1976 Moen
3,998,390 A 12/1976 Peterson et al.
3,999,714 A 12/1976 Lang
4,005,880 A 2/1977 Anderson et al.
4,006,920 A 2/1977 Sadler et al.
4,023,782 A 5/1977 Eifer
4,042,984 A 8/1977 Butler
4,045,054 A 8/1977 Arnold
D245,858 S 9/1977 Grube
D245,860 S 9/1977 Grube
4,068,801 A 1/1978 Leutheuser
4,081,135 A 3/1978 Tomaro
4,084,271 A 4/1978 Ginsberg
4,091,998 A 5/1978 Peterson
D249,356 S 9/1978 Nagy
4,117,979 A 10/1978 Lagarelli et al.
4,129,257 A 12/1978 Eggert
4,130,120 A 12/1978 Kohler, Jr.
4,131,233 A 12/1978 Koenig
4,133,486 A 1/1979 Fanella
4,135,549 A 1/1979 Baker
D251,045 S 2/1979 Grube
4,141,502 A 2/1979 Grohe
4,151,955 A 5/1979 Stouffer
4,151,957 A 5/1979 Gecewicz et al.
4,162,801 A 7/1979 Kresky et al.
4,165,837 A 8/1979 Rundzaitis
4,167,196 A 9/1979 Morris
4,174,822 A 11/1979 Larsson
4,185,781 A 1/1980 O'Brien
4,190,207 A 2/1980 Fienhold et al.
4,191,332 A 3/1980 De Langis et al.
4,203,550 A 5/1980 On
4,209,132 A 6/1980 Kwan
D255,626 S 7/1980 Grube
4,219,160 A 8/1980 Allred, Jr.
4,221,338 A 9/1980 Shames et al.
4,243,253 A 1/1981 Rogers, Jr.
4,244,526 A 1/1981 Arth
D258,677 S 3/1981 Larsson
4,254,914 A 3/1981 Shames et al.
4,258,414 A 3/1981 Sokol
4,272,022 A 6/1981 Evans
4,274,400 A 6/1981 Baus
4,282,612 A 8/1981 King
D261,300 S 10/1981 Klose
D261,417 S 10/1981 Klose
4,303,201 A 12/1981 Elkins et al.
4,319,608 A 3/1982 Raikov et al.
4,330,089 A 5/1982 Finkbeiner
D266,212 S 9/1982 Haug et al.
4,350,298 A 9/1982 Tada
4,353,508 A 10/1982 Butterfield et al.
4,358,056 A 11/1982 Greenhut et al.
D267,582 S 1/1983 Mackay et al.
D268,359 S 3/1983 Klose
D268,442 S 3/1983 Darmon
D268,611 S 4/1983 Klose
4,383,554 A 5/1983 Merriman
4,396,797 A 8/1983 Sakuragi et al.
4,398,669 A 8/1983 Fienhold
4,425,965 A 1/1984 Bayh, III et al.
4,432,392 A 2/1984 Paley
D274,457 S 6/1984 Haug
4,461,052 A 7/1984 Mostul
4,465,308 A 8/1984 Martini
4,467,964 A 8/1984 Kaeser
4,495,550 A 1/1985 Visciano
4,527,745 A 7/1985 Butterfield et al.
4,540,202 A 9/1985 Amphoux et al.
4,545,081 A 10/1985 Nestor et al.
4,553,775 A 11/1985 Halling
D281,820 S 12/1985 Oba et al.
4,561,593 A 12/1985 Cammack et al.
4,564,889 A 1/1986 Bolson
4,571,003 A 2/1986 Roling et al.
4,572,232 A 2/1986 Gruber
D283,645 S 4/1986 Tanaka
4,587,991 A 5/1986 Chorkey
4,588,130 A 5/1986 Trenary et al.
4,598,866 A 7/1986 Cammack et al.
4,614,303 A 9/1986 Moseley, Jr. et al.
4,616,298 A 10/1986 Bolson
4,618,100 A 10/1986 White et al.
4,629,124 A 12/1986 Gruber
4,629,125 A 12/1986 Liu
4,643,463 A 2/1987 Halling et al.
4,645,244 A 2/1987 Curtis
RE32,386 E 3/1987 Hunter
4,650,120 A 3/1987 Kress
4,650,470 A 3/1987 Epstein
4,652,025 A 3/1987 Conroy, Sr.
4,654,900 A 4/1987 McGhee
4,657,185 A 4/1987 Rundzaitis
4,669,666 A 6/1987 Finkbeiner
4,669,757 A 6/1987 Bartholomew
4,674,687 A 6/1987 Smith et al.
4,683,917 A 8/1987 Bartholomew
4,703,893 A 11/1987 Gruber
4,719,654 A 1/1988 Blessing
4,733,337 A 3/1988 Bieberstein
D295,437 S 4/1988 Fabian
4,739,801 A 4/1988 Kimura et al.
4,749,126 A 6/1988 Kessener et al.
D296,582 S 7/1988 Haug et al.
4,754,928 A 7/1988 Rogers et al.
D297,160 S 8/1988 Robbins
4,764,047 A 8/1988 Johnston et al.
4,778,104 A 10/1988 Fisher
4,787,591 A 11/1988 Villacorta
4,790,294 A 12/1988 Allred, III et al.
4,801,091 A 1/1989 Sandvik
4,809,369 A 3/1989 Bowden
4,839,599 A 6/1989 Fischer
4,842,059 A 6/1989 Tomek
D302,325 S 7/1989 Charet et al.
4,850,616 A 7/1989 Pava
4,854,499 A 8/1989 Neuman
4,856,822 A 8/1989 Parker
4,865,362 A 9/1989 Holden
D303,830 S 10/1989 Ramsey et al.
4,871,196 A 10/1989 Kingsford
4,896,658 A 1/1990 Yonekubo et al.
D306,351 S 2/1990 Charet et al.
4,901,927 A 2/1990 Valdivia
4,903,178 A 2/1990 Englot et al.
4,903,897 A 2/1990 Hayes 4,903,922 A 2/1990 Harris, III
4,907,137 A 3/1990 Schladitz et al.
4,907,744 A 3/1990 Jousson
4,909,435 A 3/1990 Kidouchi et al.
4,914,759 A 4/1990 Goff
4,946,202 A 8/1990 Perricone
4,951,329 A 8/1990 Shaw
4,953,585 A 9/1990 Rollini et al.
4,964,573 A 10/1990 Lipski
4,972,048 A 11/1990 Martin
D313,267 S 12/1990 Lenci et al.
4,976,460 A 12/1990 Newcombe et al.
D314,246 S 1/1991 Bache
D315,191 S 3/1991 Mikol
4,998,673 A 3/1991 Pilolla
5,004,158 A 4/1991 Halem et al.
D317,348 S 6/1991 Geneve et al.
5,020,570 A 6/1991 Cotter
5,022,103 A 6/1991 Faist
5,032,015 A 7/1991 Christianson
5,033,528 A 7/1991 Volcani
5,033,897 A 7/1991 Chen
D319,294 S 8/1991 Kohler, Jr. et al.
D320,064 S 9/1991 Presman
5,046,764 A 9/1991 Kimura et al.
D321,062 S 10/1991 Bonbright
5,058,804 A 10/1991 Yonekubo et al.
D322,119 S 12/1991 Haug et al.
D322,681 S 12/1991 Yuen
5,070,552 A 12/1991 Gentry et al.
D323,545 S 1/1992 Ward
5,082,019 A 1/1992 Tetrault
5,086,878 A 2/1992 Swift
5,090,624 A 2/1992 Rogers
5,100,055 A 3/1992 Rokitenetz et al.
D325,769 S 4/1992 Haug et al.
D325,770 S 4/1992 Haug et al.
5,103,384 A 4/1992 Drohan
D326,311 S 5/1992 Lenci et al.
D327,115 S 6/1992 Rogers
5,121,511 A 6/1992 Sakamoto et al.
D327,729 S 7/1992 Rogers
5,127,580 A 7/1992 Fu-I
5,134,251 A 7/1992 Martin
D328,944 S 8/1992 Robbins
5,141,016 A 8/1992 Nowicki
D329,504 S 9/1992 Yuen
5,143,300 A 9/1992 Cutler
5,145,114 A 9/1992 Monch
5,148,556 A 9/1992 Bottoms et al.
D330,068 S 10/1992 Haug et al.
D330,408 S 10/1992 Thacker
D330,409 S 10/1992 Raffo
5,153,976 A 10/1992 Benchaar et al.
5,154,355 A 10/1992 Gonzalez
5,154,483 A 10/1992 Zeller
5,161,567 A 11/1992 Humpert
5,163,752 A 11/1992 Copeland et al.
5,171,429 A 12/1992 Yasuo
5,172,860 A 12/1992 Yuch
5,172,862 A 12/1992 Heimann et al.
5,172,866 A 12/1992 Ward
D332,303 S 1/1993 Klose
D332,994 S 2/1993 Huen
D333,339 S 2/1993 Klose
5,197,767 A 3/1993 Kimura et al.
D334,794 S 4/1993 Klose
D335,171 S 4/1993 Lenci et al.
5,201,468 A 4/1993 Freier et al.
5,206,963 A 5/1993 Wiens
5,207,499 A 5/1993 Vajda et al.
5,213,267 A 5/1993 Heimann et al.
5,220,697 A 6/1993 Birchfield
D337,839 S 7/1993 Zeller
5,228,625 A 7/1993 Grassberger
5,230,106 A 7/1993 Henkin et al.
D338,542 S 8/1993 Yuen
5,232,162 A 8/1993 Chih
D339,492 S 9/1993 Klose
D339,627 S 9/1993 Klose
D339,848 S 9/1993 Gottwald
5,246,169 A 9/1993 Heimann et al.
5,246,301 A 9/1993 Hirasawa
D340,376 S 10/1993 Klose
5,253,670 A 10/1993 Perrott
5,253,807 A 10/1993 Newbegin
5,254,809 A 10/1993 Martin
D341,007 S 11/1993 Haug et al.
D341,191 S 11/1993 Klose
D341,220 S 11/1993 Eagan
5,263,646 A 11/1993 McCauley
5,265,833 A 11/1993 Heimann et al.
5,268,826 A 12/1993 Greene
5,276,596 A 1/1994 Krenzel
5,277,391 A 1/1994 Haug et al.
5,286,071 A 2/1994 Storage
5,288,110 A 2/1994 Allread
5,294,054 A 3/1994 Benedict et al.
5,297,735 A * 3/1994 Heimann et al. ..... 239/600
5,297,739 A 3/1994 Allen
D345,811 S 4/1994 Van Deursen et al.
D346,426 S 4/1994 Warshawsky
D346,428 S 4/1994 Warshawsky
D346,430 S 4/1994 Warshawsky
D347,262 S 5/1994 Black et al.
D347,265 S 5/1994 Gottwald
5,316,216 A 5/1994 Cammack et al.
D348,720 S 7/1994 Haug et al.
5,329,650 A 7/1994 Zaccai et al.
D349,947 S 8/1994 Hing-Wah
5,333,787 A 8/1994 Smith et al.
5,333,789 A 8/1994 Garneys
5,340,064 A 8/1994 Heimann et al.
5,340,165 A 8/1994 Sheppard
D350,808 S 9/1994 Warshawsky
5,344,080 A 9/1994 Matsui
5,349,987 A 9/1994 Shieh
5,356,076 A 10/1994 Bishop
5,356,077 A 10/1994 Shames
D352,092 S 11/1994 Warshawsky
D352,347 S 11/1994 Dannenberg
D352,766 S 11/1994 Hill et al.
5,368,235 A 11/1994 Drozdoff et al.
5,369,556 A 11/1994 Zeller
5,370,427 A 12/1994 Hoelle et al.
5,385,500 A 1/1995 Schmidt
D355,242 S 2/1995 Warshawsky
D355,703 S 2/1995 Duell
D356,626 S 3/1995 Wang
5,397,064 A 3/1995 Heitzman
5,398,872 A 3/1995 Joubran
5,398,977 A 3/1995 Berger et al.
5,402,812 A 4/1995 Moineau et al.
5,405,089 A 4/1995 Heimann et al.
5,414,879 A 5/1995 Hiraishi et al.
5,423,348 A 6/1995 Jezek et al.
5,433,384 A 7/1995 Chan et al.
D361,399 S 8/1995 Carbone et al.
D361,623 S 8/1995 Huen
5,441,075 A 8/1995 Clare
5,449,206 A 9/1995 Lockwood
D363,360 S 10/1995 Santarsiero
5,454,809 A 10/1995 Janssen
5,468,057 A 11/1995 Megerle et al.
D364,935 S 12/1995 deBlois
D365,625 S 12/1995 Bova D365,646 S 12/1995 deBlois
5,476,225 A 12/1995 Chan
D366,309 S 1/1996 Huang
D366,707 S 1/1996 Kaiser
D366,708 S 1/1996 Santarsiero
D366,709 S 1/1996 Szymanski
D366,710 S 1/1996 Szymanski
5,481,765 A 1/1996 Wang
D366,948 S 2/1996 Carbone
D367,315 S 2/1996 Andrus
D367,333 S 2/1996 Swyst
D367,696 S 3/1996 Andrus
D367,934 S 3/1996 Carbone
D368,146 S 3/1996 Carbone
D368,317 S 3/1996 Swyst
5,499,767 A 3/1996 Morand
D368,539 S 4/1996 Carbone et al.
D368,540 S 4/1996 Santarsiero
D368,541 S 4/1996 Kaiser et al.
D368,542 S 4/1996 deBlois et al.
D369,204 S 4/1996 Andrus
D369,205 S 4/1996 Andrus
5,507,436 A 4/1996 Ruttenberg
D369,873 S 5/1996 deBlois et al.
D369,874 S 5/1996 Santarsiero
D369,875 S 5/1996 Carbone
D370,052 S 5/1996 Chan et al.
D370,250 S 5/1996 Fawcett et al.
D370,277 S 5/1996 Kaiser
D370,278 S 5/1996 Nolan
D370,279 S 5/1996 deBlois
D370,280 S 5/1996 Kaiser
D370,281 S 5/1996 Johnstone et al.
5,517,392 A 5/1996 Rousso et al.
5,521,803 A 5/1996 Eckert et al.
D370,542 S 6/1996 Santarsiero
D370,735 S 6/1996 deBlois
D370,987 S 6/1996 Santarsiero
D370,988 S 6/1996 Santarsiero
D371,448 S 7/1996 Santarsiero
D371,618 S 7/1996 Nolan
D371,619 S 7/1996 Szymanski
D371,856 S 7/1996 Carbone
D372,318 S 7/1996 Szymanski
D372,319 S 7/1996 Carbone
5,531,625 A 7/1996 Zhong
5,539,624 A 7/1996 Dougherty
D372,548 S 8/1996 Carbone
D372,998 S 8/1996 Carbone
D373,210 S 8/1996 Santarsiero
D373,434 S 9/1996 Nolan
D373,435 S 9/1996 Nolan
D373,645 S 9/1996 Johnstone et al.
D373,646 S 9/1996 Szymanski et al.
D373,647 S 9/1996 Kaiser
D373,648 S 9/1996 Kaiser
D373,649 S 9/1996 Carbone
D373,651 S 9/1996 Szymanski
D373,652 S 9/1996 Kaiser
5,551,637 A 9/1996 Lo
5,552,973 A 9/1996 Hsu
5,558,278 A 9/1996 Gallorini
D374,271 S 10/1996 Fleischmann
D374,297 S 10/1996 Kaiser
D374,298 S 10/1996 Swyst
D374,299 S 10/1996 Carbone
D374,493 S 10/1996 Szymanski
D374,494 S 10/1996 Santarsiero
D374,732 S 10/1996 Kaiser
D374,733 S 10/1996 Santasiero
5,560,548 A 10/1996 Mueller et al.
5,567,115 A 10/1996 Carbone
D375,541 S 11/1996 Michaluk
5,577,664 A 11/1996 Heitzman
D376,217 S 12/1996 Kaiser
D376,860 S 12/1996 Santarsiero
D376,861 S 12/1996 Johnstone et al.
D376,862 S 12/1996 Carbone
5,605,173 A 2/1997 Arnaud
D378,401 S 3/1997 Neufeld et al.
5,613,638 A 3/1997 Blessing
5,613,639 A 3/1997 Storm et al.
5,615,837 A 4/1997 Roman
5,624,074 A 4/1997 Parisi
5,624,498 A 4/1997 Lee et al.
D379,212 S 5/1997 Chan
D379,404 S 5/1997 Spelts
5,632,049 A 5/1997 Chen
D381,405 S 7/1997 Waidele et al.
D381,737 S 7/1997 Chan
D382,936 S 8/1997 Shfaram
5,653,260 A 8/1997 Huber
5,667,146 A 9/1997 Pimentel et al.
D385,332 S 10/1997 Andrus
D385,333 S 10/1997 Caroen et al.
D385,334 S 10/1997 Caroen et al.
D385,616 S 10/1997 Dow et al.
D385,947 S 11/1997 Dow et al.
D387,230 S 12/1997 von Buelow et al.
5,699,964 A 12/1997 Bergmann et al.
5,702,057 A 12/1997 Huber
D389,558 S 1/1998 Andrus
5,704,080 A 1/1998 Kuhne
5,718,380 A 2/1998 Schorn et al.
D392,369 S 3/1998 Chan
5,730,361 A 3/1998 Thonnes
5,730,362 A 3/1998 Cordes
5,730,363 A 3/1998 Kress
5,742,961 A 4/1998 Casperson et al.
D394,490 S 5/1998 Andrus et al.
5,746,375 A 5/1998 Guo
5,749,552 A 5/1998 Fan
5,749,602 A 5/1998 Delaney et al.
D394,899 S 6/1998 Caroen et al.
D395,074 S 6/1998 Neibrook
D395,075 S 6/1998 Neibrook et al.
D395,142 S 6/1998 Neibrook
5,765,760 A 6/1998 Kuo
5,769,802 A 6/1998 Wang
5,772,120 A 6/1998 Huber
5,778,939 A 7/1998 Hok-Yin
5,788,157 A 8/1998 Kress
D398,370 S 9/1998 Purdy
5,806,771 A 9/1998 Loschelder et al.
5,819,791 A 10/1998 Chronister et al.
5,820,574 A 10/1998 Henkin et al.
5,823,431 A 10/1998 Pierce
5,823,442 A 10/1998 Guo
5,833,138 A 11/1998 Crane et al.
5,839,666 A 11/1998 Heimann et al.
D402,350 S 12/1998 Andrus
D403,754 S 1/1999 Gottwald
D404,116 S 1/1999 Bosio
5,855,348 A 1/1999 Fornara
5,860,599 A 1/1999 Lin
5,862,543 A 1/1999 Reynoso et al.
5,862,985 A 1/1999 Neibrook et al.
D405,502 S 2/1999 Tse
5,865,375 A 2/1999 Hsu
5,865,378 A 2/1999 Hollinshead et al.
5,873,647 A 2/1999 Kurtz et al.
D408,893 S 4/1999 Tse
D409,276 S 5/1999 Ratzlaff
D410,276 S 5/1999 Ben-Tsur
5,918,809 A 7/1999 Simmons
5,918,811 A 7/1999 Denham et al.

D413,157 S 8/1999 Ratzlaff
5,937,905 A 8/1999 Santos
5,938,123 A 8/1999 Heitzman
5,947,388 A 9/1999 Woodruff
D415,247 S 10/1999 Haverstraw et al.
5,961,046 A 10/1999 Joubran
5,979,776 A 11/1999 Williams
5,992,762 A 11/1999 Wang
D418,200 S 12/1999 Ben-Tsur
5,997,047 A 12/1999 Pimentel et al.
6,003,165 A 12/1999 Loyd
D418,902 S 1/2000 Haverstraw et al.
D418,903 S 1/2000 Haverstraw et al.
D418,904 S 1/2000 Milrud
D421,099 S 2/2000 Mullenmeister
6,021,960 A 2/2000 Kehat
D422,053 S 3/2000 Brenner et al.
6,042,027 A 3/2000 Sandvik
6,042,155 A 3/2000 Lockwood
D422,336 S 4/2000 Haverstraw et al.
D422,337 S 4/2000 Chan
D423,083 S 4/2000 Haug et al.
D423,110 S 4/2000 Cipkowski
D424,160 S 5/2000 Haug et al.
D424,161 S 5/2000 Haug et al.
D424,162 S 5/2000 Haug et al.
D424,163 S 5/2000 Haug et al.
D426,290 S 6/2000 Haug et al.
D427,661 S 7/2000 Haverstraw et al.
D428,110 S 7/2000 Haug et al.
D428,125 S 7/2000 Chan
6,085,780 A 7/2000 Morris
D430,267 S 8/2000 Milrud et al.
6,095,801 A 8/2000 Spiewak
D430,643 S 9/2000 Tse
6,113,002 A 9/2000 Finkbeiner
6,123,272 A 9/2000 Havican et al.
6,123,308 A 9/2000 Faisst
D432,624 S 10/2000 Chan
D432,625 S 10/2000 Chan
D433,096 S 10/2000 Tse
D433,097 S 10/2000 Tse
6,126,091 A 10/2000 Heitzman
6,126,290 A 10/2000 Veigel
D434,109 S 11/2000 Ko
6,164,569 A 12/2000 Hollinshead et al.
6,164,570 A 12/2000 Smeltzer
D435,889 S 1/2001 Ben-Tsur et al.
D439,305 S 3/2001 Slothower
6,199,580 B1 3/2001 Morris
6,202,679 B1 3/2001 Titus
D440,276 S 4/2001 Slothower
D440,277 S 4/2001 Slothower
D440,278 S 4/2001 Slothower
D441,059 S 4/2001 Fleischmann
6,209,799 B1 4/2001 Finkbeiner
D443,025 S 5/2001 Kollmann et al.
D443,026 S 5/2001 Kollmann et al.
D443,027 S 5/2001 Kollmann et al.
D443,029 S 5/2001 Kollmann et al.
6,223,998 B1 5/2001 Heitzman
6,230,984 B1 5/2001 Jager
6,230,988 B1 5/2001 Chao et al.
6,230,989 B1 5/2001 Haverstraw et al.
D443,335 S 6/2001 Andrus
D443,336 S 6/2001 Kollmann et al.
D443,347 S 6/2001 Gottwald
6,250,572 B1 6/2001 Chen
D444,865 S 7/2001 Gottwald
D445,871 S 7/2001 Fan
6,254,014 B1 7/2001 Clearman et al.
6,270,278 B1 8/2001 Mauro
6,276,004 B1 8/2001 Bertrand et al.
6,283,447 B1 9/2001 Fleet
6,286,764 B1 9/2001 Garvey et al.
D449,673 S 10/2001 Kollmann et al.
D450,370 S 11/2001 Wales et al.
D450,805 S 11/2001 Lindholm et al.
D450,806 S 11/2001 Lindholm et al.
D450,807 S 11/2001 Lindholm et al.
D451,169 S 11/2001 Lindholm et al.
D451,170 S 11/2001 Lindholm et al.
D451,171 S 11/2001 Lindholm et al.
D451,172 S 11/2001 Lindholm et al.
6,321,777 B1 11/2001 Wu
6,322,006 B1 * 11/2001 Guo ..... 239/532
D451,583 S 12/2001 Lindholm et al.
D451,980 S 12/2001 Lindholm et al.
D452,553 S 12/2001 Lindholm et al.
D452,725 S 1/2002 Lindholm et al.
D452,897 S 1/2002 Gillette et al.
D453,369 S 2/2002 Lobermeier
D453,370 S 2/2002 Lindholm et al.
D453,551 S 2/2002 Lindholm et al.
6,349,735 B2 2/2002 Gul
D454,617 S 3/2002 Curbbun et al.
D454,938 S 3/2002 Lord
6,375,342 B1 4/2002 Koren et al.
D457,937 S 5/2002 Lindholm et al.
6,382,531 B1 5/2002 Tracy
D458,348 S 6/2002 Mullenmeister
6,412,711 B1 7/2002 Fan
D461,224 S 8/2002 Lobermeier
D461,878 S 8/2002 Green et al.
6,450,425 B1 9/2002 Chen
6,454,186 B2 9/2002 Haverstraw et al.
6,464,265 B1 10/2002 Mikol
D465,552 S 11/2002 Tse
D465,553 S 11/2002 Singtoroj
6,484,952 B2 11/2002 Koren
D468,800 S 1/2003 Tse
D469,165 S 1/2003 Lim
6,502,796 B1 1/2003 Wales
D470,219 S 2/2003 Schweitzer
6,516,070 B2 2/2003 Macey
D471,253 S 3/2003 Tse
D471,953 S 3/2003 Colligan et al.
6,533,194 B2 3/2003 Marsh et al.
6,537,455 B2 3/2003 Farley
D472,958 S 4/2003 Ouyoung
6,550,697 B2 4/2003 Lai
6,595,439 B1 * 7/2003 Chen ..... 239/280
6,607,148 B1 8/2003 Marsh et al.
6,611,971 B1 9/2003 Antoniello et al.
6,637,676 B2 10/2003 Zieger et al.
6,641,057 B2 11/2003 Thomas et al.
D483,837 S 12/2003 Fan
6,659,117 B2 12/2003 Gilmore
6,659,372 B2 12/2003 Marsh et al.
D485,887 S 1/2004 Luettgen et al.
D486,888 S 2/2004 Lobermeier
6,691,338 B2 2/2004 Zieger
D487,301 S 3/2004 Haug et al.
D487,498 S 3/2004 Blomstrom
6,701,953 B2 3/2004 Agosta
D489,798 S 5/2004 Hunt
D490,498 S 5/2004 Golichowski
6,736,336 B2 5/2004 Wong
6,739,523 B2 5/2004 Haverstraw et al.
6,739,527 B1 5/2004 Chung
D492,004 S 6/2004 Haug et al.
D492,007 S 6/2004 Kollmann et al.
6,742,725 B1 6/2004 Fan
D493,208 S 7/2004 Lin
D493,864 S 8/2004 Haug et al.
D494,655 S 8/2004 Lin

| | | | | |
|---|---|---|---|---|
| D494,661 | S | 8/2004 | Zieger et al. | |
| D495,027 | S | 8/2004 | Mazzola | |
| 6,776,357 | B1 | 8/2004 | Naito | |
| 6,789,751 | B1 * | 9/2004 | Fan | 239/587.1 |
| D496,987 | S | 10/2004 | Glunk | |
| D497,974 | S | 11/2004 | Haug et al. | |
| D498,514 | S | 11/2004 | Haug et al. | |
| D500,121 | S | 12/2004 | Blomstrom | |
| D500,549 | S | 1/2005 | Blomstrom | |
| D501,242 | S | 1/2005 | Blomstrom | |
| D502,760 | S | 3/2005 | Zieger et al. | |
| D502,761 | S | 3/2005 | Zieger et al. | |
| D503,211 | S | 3/2005 | Lin | |
| D503,774 | S | 4/2005 | Zieger | |
| D503,775 | S | 4/2005 | Zieger | |
| D503,966 | S | 4/2005 | Zieger | |
| 6,899,292 | B2 | 5/2005 | Titinet | |
| D506,243 | S | 6/2005 | Wu | |
| D507,037 | S | 7/2005 | Wu | |
| 6,935,581 | B2 | 8/2005 | Titinet | |
| D509,280 | S | 9/2005 | Bailey et al. | |
| D509,563 | S | 9/2005 | Bailey et al. | |
| D510,123 | S | 9/2005 | Tsai | |
| D511,809 | S | 11/2005 | Haug et al. | |
| D512,119 | S | 11/2005 | Haug et al. | |
| 6,981,661 | B1 | 1/2006 | Chen | |
| 7,000,854 | B2 * | 2/2006 | Malek et al. | 239/525 |
| 7,004,409 | B2 | 2/2006 | Okubo | |
| D520,109 | S | 5/2006 | Wu | |
| 7,048,210 | B2 | 5/2006 | Clark | |
| 7,055,767 | B1 | 6/2006 | Ko | |
| 7,070,125 | B2 | 7/2006 | Williams et al. | |
| D527,440 | S | 8/2006 | Macan | |
| D528,631 | S | 9/2006 | Gillette et al. | |
| 7,100,845 | B1 | 9/2006 | Hsieh | |
| 7,111,798 | B2 | 9/2006 | Thomas et al. | |
| D530,389 | S | 10/2006 | Genslak et al. | |
| D530,392 | S | 10/2006 | Tse | |
| 7,114,666 | B2 | 10/2006 | Luettgen et al. | |
| D533,253 | S | 12/2006 | Luettgen et al. | |
| D534,239 | S | 12/2006 | Dingler et al. | |
| D535,354 | S | 1/2007 | Wu | |
| D536,060 | S | 1/2007 | Sadler | |
| 7,156,325 | B1 | 1/2007 | Chen | |
| D538,391 | S | 3/2007 | Mazzola | |
| D540,424 | S | 4/2007 | Kirar | |
| D540,425 | S | 4/2007 | Endo et al. | |
| D540,426 | S | 4/2007 | Cropelli | |
| D540,427 | S | 4/2007 | Bouroullec et al. | |
| D542,391 | S | 5/2007 | Gilbert | |
| D542,393 | S | 5/2007 | Haug et al. | |
| 7,229,031 | B2 | 6/2007 | Schmidt | |
| 7,243,863 | B2 | 7/2007 | Glunk | |
| D552,713 | S | 10/2007 | Rexach | |
| 7,278,591 | B2 | 10/2007 | Clearman et al. | |
| D556,295 | S | 11/2007 | Genord et al. | |
| 7,299,510 | B2 | 11/2007 | Tsai | |
| D557,763 | S | 12/2007 | Schonherr et al. | |
| D557,764 | S | 12/2007 | Schonherr et al. | |
| D557,765 | S | 12/2007 | Schonherr et al. | |
| D558,301 | S | 12/2007 | Hoernig | |
| 7,303,151 | B2 | 12/2007 | Wu | |
| D559,357 | S | 1/2008 | Wang et al. | |
| D559,945 | S | 1/2008 | Patterson et al. | |
| D560,269 | S | 1/2008 | Tse | |
| D562,937 | S | 2/2008 | Schonherr et al. | |
| D562,938 | S | 2/2008 | Blessing | |
| D562,941 | S | 2/2008 | Pan | |
| 7,331,536 | B1 | 2/2008 | Zhen et al. | |
| 7,347,388 | B2 | 3/2008 | Chung | |
| D565,699 | S | 4/2008 | Berberet | |
| D565,703 | S | 4/2008 | Lammel et al. | |
| D566,228 | S | 4/2008 | Neagoe | |
| D566,229 | S | 4/2008 | Rexach | |
| D567,328 | S | 4/2008 | Spangler et al. | |
| 7,360,723 | B2 | 4/2008 | Lev | |
| 7,364,097 | B2 | 4/2008 | Okuma | |
| 7,374,112 | B1 | 5/2008 | Bulan et al. | |
| 7,384,007 | B2 | 6/2008 | Ho | |
| D577,099 | S | 9/2008 | Leber | |
| D577,793 | S | 9/2008 | Leber | |
| D580,012 | S | 11/2008 | Quinn et al. | |
| D580,513 | S | 11/2008 | Quinn et al. | |
| D581,014 | S | 11/2008 | Quinn et al. | |
| D516,169 | S | 2/2009 | Wu | |
| 7,520,448 | B2 | 4/2009 | Luettgen et al. | |
| 2003/0062426 | A1 | 4/2003 | Gregory et al. | |
| 2004/0118949 | A1 | 6/2004 | Marks | |
| 2005/0001072 | A1 | 1/2005 | Bolus et al. | |
| 2005/0082824 | A1 | 4/2005 | Luettgen et al. | |
| 2005/0284967 | A1 | 12/2005 | Korb | |
| 2006/0016913 | A1 | 1/2006 | Lo | |
| 2006/0043214 | A1 | 3/2006 | Macan et al. | |
| 2006/0060678 | A1 | 3/2006 | Mazzola | |
| 2006/0102747 | A1 | 5/2006 | Ho | |
| 2006/0157590 | A1 | 7/2006 | Clearman et al. | |
| 2006/0163391 | A1 | 7/2006 | Schorn | |
| 2006/0219822 | A1 | 10/2006 | Miller et al. | |
| 2006/0283986 | A1 | 12/2006 | Chung | |
| 2007/0040054 | A1 | 2/2007 | Farzan | |
| 2007/0200013 | A1 | 8/2007 | Hsiao | |
| 2007/0246577 | A1 | 10/2007 | Leber | |
| 2007/0272770 | A1 | 11/2007 | Leber et al. | |
| 2008/0073449 | A1 | 3/2008 | Haynes et al. | |
| 2008/0083844 | A1 | 4/2008 | Leber et al. | |
| 2008/0111004 | A1 | 5/2008 | Huffman | |
| 2008/0121293 | A1 | 5/2008 | Leber | |
| 2008/0156897 | A1 | 7/2008 | Leber | |
| 2008/0156902 | A1 | 7/2008 | Luettgen et al. | |
| 2008/0223957 | A1 | 9/2008 | Schorn | |
| 2008/0272203 | A1 | 11/2008 | Leber | |
| 2008/0272591 | A1 | 11/2008 | Leber | |

FOREIGN PATENT DOCUMENTS

| | | |
|---|---|---|
| CH | 234284 | 3/1963 |
| DE | 352813 | 5/1922 |
| DE | 848627 | 9/1952 |
| DE | 854100 | 10/1952 |
| DE | 2360534 | 6/1974 |
| DE | 2806093 | 8/1979 |
| DE | 3107808 | 9/1982 |
| DE | 3246327 | 6/1984 |
| DE | 3440901 | 7/1985 |
| DE | 3706320 | 3/1988 |
| DE | 8804236 | 6/1988 |
| DE | 4034695 | 5/1991 |
| DE | 19608085 | 9/1996 |
| EP | 0167063 | 6/1985 |
| EP | 0478999 | 4/1992 |
| EP | 0514753 | 11/1992 |
| EP | 0617644 | 10/1994 |
| EP | 0683354 | 11/1995 |
| EP | 0687851 | 12/1995 |
| EP | 0695907 | 2/1996 |
| EP | 0719588 | 7/1996 |
| EP | 0721082 | 7/1996 |
| EP | 0733747 | 9/1996 |
| EP | 0808661 | 11/1997 |
| EP | 0726811 | 1/1998 |
| FR | 538538 | 6/1922 |
| FR | 873808 | 7/1942 |
| FR | 1039750 | 10/1953 |
| FR | 1098836 | 8/1955 |
| FR | 2596492 | 10/1987 |
| FR | 2695452 | 3/1994 |

| | | | |
|---|---|---|---|
| GB | 3314 | | 0/1914 |
| GB | 10086 | | 0/1894 |
| GB | 129812 | | 7/1919 |
| GB | 204600 | | 10/1923 |
| GB | 634483 | | 3/1950 |
| GB | 971866 | | 10/1964 |
| GB | 1111126 | | 4/1968 |
| GB | 2066074 | | 1/1980 |
| GB | 2066704 | | 7/1981 |
| GB | 2068778 | | 8/1981 |
| GB | 2121319 | | 12/1983 |
| GB | 2155984 | | 10/1985 |
| GB | 2156932 | A | 10/1985 |
| GB | 2199771 | | 7/1988 |
| GB | 2298595 | | 11/1996 |
| IT | 327400 | | 7/1935 |
| IT | 350359 | | 7/1937 |
| IT | 563459 | | 5/1957 |
| JP | S63-181459 | | 11/1988 |
| JP | H2-78660 | | 6/1990 |
| JP | 4062238 | | 2/1992 |
| JP | 4146708 | | 5/1992 |
| NL | 8902957 | | 6/1991 |
| WO | WO93/12894 | | 7/1993 |
| WO | WO93/25839 | | 12/1993 |
| WO | WO96/00617 | | 1/1996 |
| WO | WO98/30336 | | 7/1998 |
| WO | WO00/10720 | | 3/2000 |

OTHER PUBLICATIONS

Color Copy, Labeled 1B, Gemlo, available at least as early as Dec. 2, 1998.

* cited by examiner

HAND SHOWER WITH AN EXTENDABLE HANDLE

CROSS REFERENCE TO RELATED APPLICATION(S)

This application claims benefit under 35 U.S.C. §119(e) to U.S. Ser. No. 60/882,414, entitled "Hand Shower with an Extendable Handle", filed Dec. 28, 2006, the contents of which are incorporated herein by reference in their entirety.

FIELD OF THE INVENTION

The present invention relates to a handheld shower assembly. More specifically, the present invention relates to an adjustable handle configuration.

BACKGROUND OF THE INVENTION

Generally, handheld shower assemblies are used to direct water from a home water supply for personal hygiene purposes. As handheld shower assemblies increase in popularity, demand for new and innovative designs for handheld shower assemblies also increase. Over time, several possible shortcomings have been identified with existing handheld shower assembly designs. For example, many existing handheld shower assemblies have a fixed length preventing an attached shower handle from extending along the axial length of the assembly. Additionally, many handheld shower assemblies do not provide adjustable handles sufficient or long enough for a user to direct the water delivery angle onto remote areas of the body, such as one's back.

Accordingly, there is need in the art for a handheld shower assembly with an angularly adjustable handle that allows repositioning of a showerhead. There is also need in the art for a handheld shower assembly having an adjustable length handle.

SUMMARY

One exemplary embodiment of the present invention takes the form of a handheld shower assembly. The handheld shower assembly may include a water conduit, an adjustable handle, and a showerhead. The water conduit is adapted to attach to a standard shower pipe extending from a wall of a shower stall and receives water flow from the shower pipe. The handle includes a first portion and a second portion adapted to receive the water conduit in an interior handle portion. The first portion is adjustably coupled to the second portion. The first portion may telescope with respect to the second portion, thereby the first portion extends from a first retracted position to a second extended position. The showerhead is operably coupled to the water conduit and the handle and may receive water flow from the water conduit as well as expel water.

A second embodiment of the present invention may take the form of a method for manufacturing a handheld shower assembly. The method may include coupling a first portion and a second portion to form an adjustable handle in which the first portion slides from a first retracted position to a second extended position. The first portion extends at least partly outwardly from the second portion when in the first position and retraced at least partly within the second portion relative to the first portion when in the second position. The method may also include coupling a showerhead to a hose extending through an interior of the adjustable handle. The hose is adapted to receive and transport water from a water source to the showerhead, and the showerhead is configured to distribute the water flow. The method may further include coupling the showerhead to the adjustable handle in a manner that allows the angle of water flow distribution to be adjusted in response to axially adjusting the handle.

While multiple embodiments of the present invention are disclosed herein, still other embodiments of the present invention will become apparent to those skilled in the art from the following detailed description, which shows and describes illustrative embodiments of the invention. As will be realized, by those of ordinary skill in the art upon reading the following disclosure, the invention is capable of modifications in various aspects, all without departing from the spirit and scope of the present invention. Accordingly, the drawings and detailed description are to be regarded as illustrative in nature and not restrictive.

DETAILED DESCRIPTION

The present application discloses a handheld shower assembly 10. The handheld shower assembly 10 includes an adjustable handle that allows a user to manipulate an overall length of the adjustable handle. The following paragraphs provide a detailed description of the handheld shower assembly 10.

Figure 1:
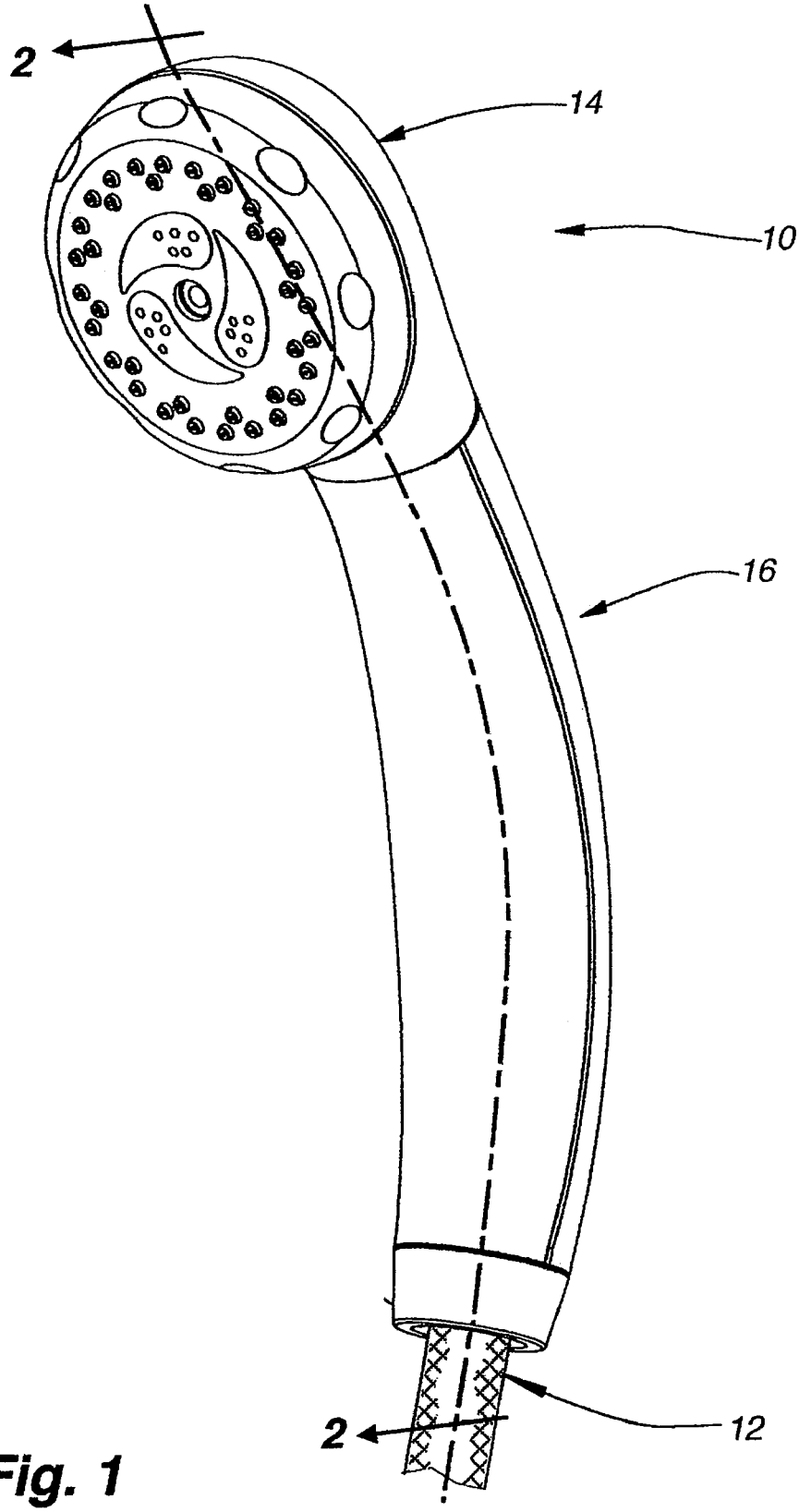
FIG. 1 is perspective view of a handheld shower assembly having an adjustable handle shown in a first position, in accordance with an exemplary embodiment of the present invention.
Figure 2:
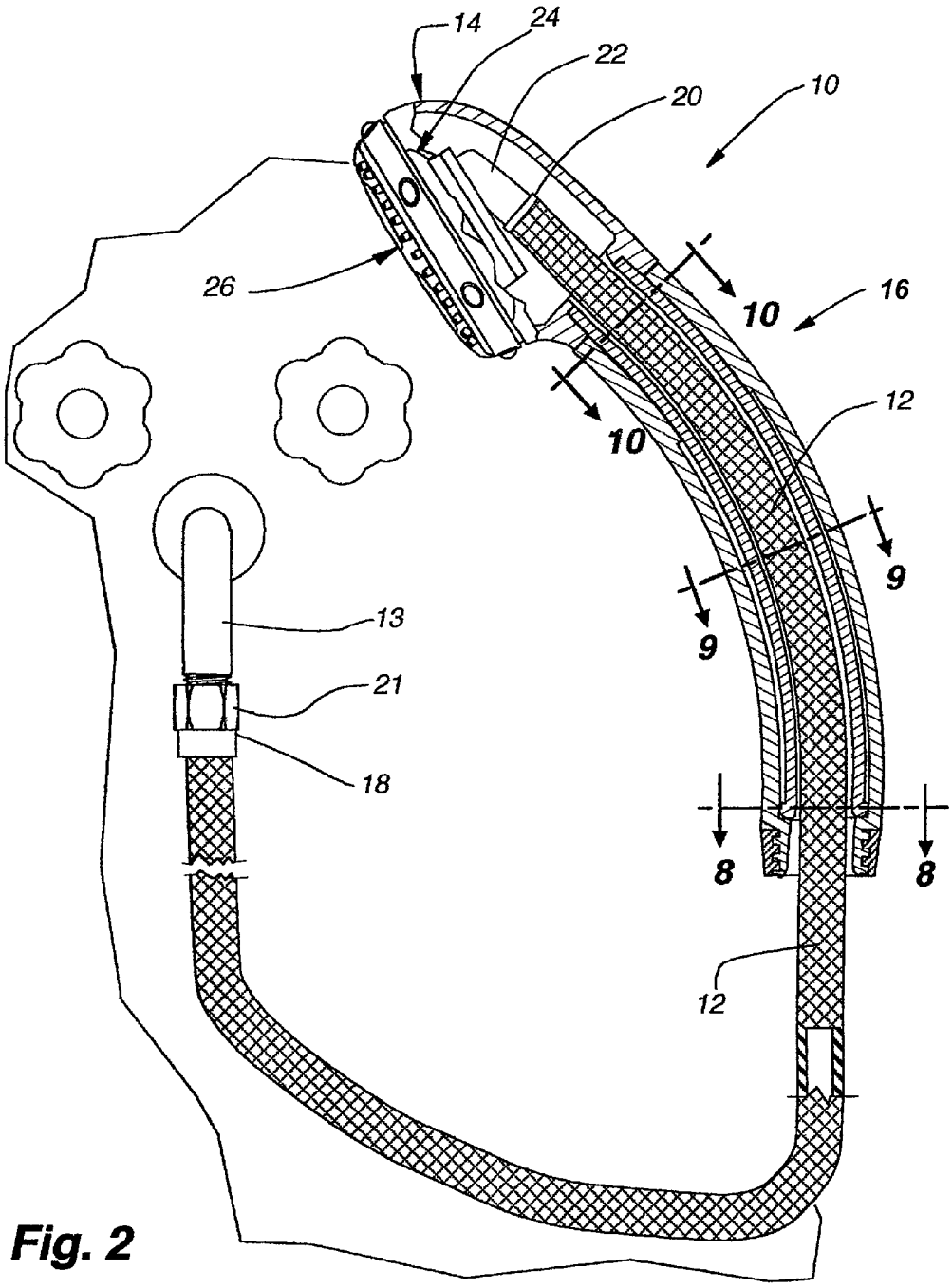
FIG. 2 is a cross-sectional view of the handheld shower assembly of FIG. 1, taken along lines 2-2 of FIG. 1.
Figure 3:
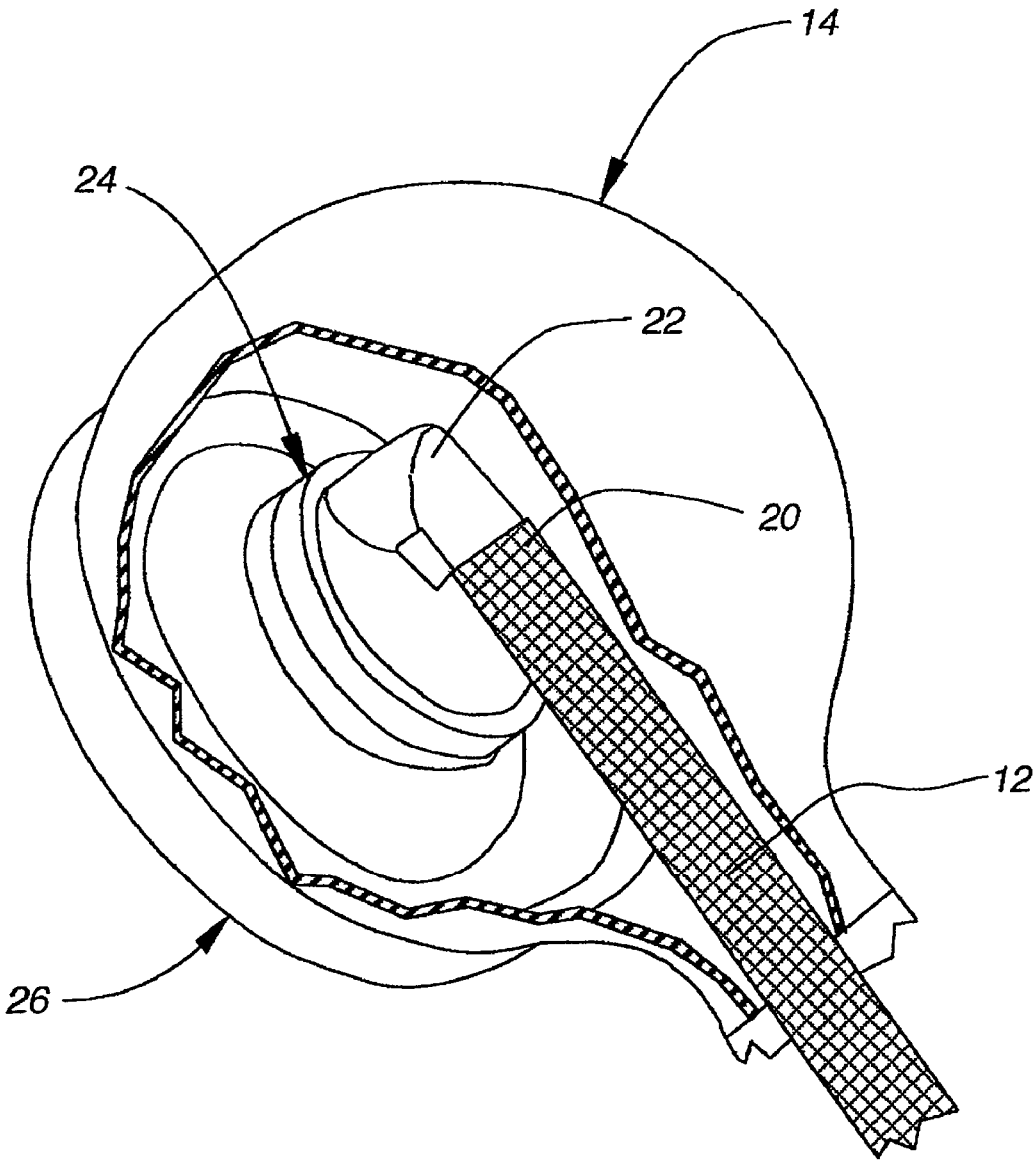
FIG. 3 is a perspective view of a showerhead of the handheld shower assembly of FIG. 1.

One exemplary embodiment of the handheld shower assembly 10 is described herein with respect to FIGS. 1-4. FIG. 1 is a perspective view of the handheld shower assembly 10. As shown in FIG. 1, the handheld shower assembly 10 may include a water conduit 12, a showerhead 14, and an adjustable handle 16 occupying a first or retracted position. FIG. 2 is an illustration of a cross-sectional view of the handheld shower assembly 10 of FIG. 1 taken along lines 2-2 in FIG. 1. Coupled to one end of the water conduit 12 is a standard shower pipe 13 extending, for example, from a wall. According to this configuration, water conduit 12 extends from a water source, through the adjustable handle 16 of shower assembly 10, and is coupled to showerhead 14 to form a water-tight seal (See FIG. 3).

According to implementations of the invention, a single water-tight connection or seal is formed, e.g., between water conduit 12 and showerhead 14, as opposed to providing multiple water-tight seals between, for example, a terminal end of water conduit 12 and an end of the adjustable handle 16 closest to a water source, between overlapping portions of adjustable handle 16, and between the end of adjustable handle 16 closest to showerhead 14 and showerhead 14. Each of the above-described water-tight connections has a potential for failure, and as a result, providing as few water connections as possible, like in the present invention, is desirable. Thus, according to further implementations, water conduit 12 and the portion of showerhead 14 connected thereto may be formed as a unitary piece or may be welded, secured or locked together.

In addition, by providing a seal between water conduit 12 and showerhead 14, water pressure is not exerted on the movable joints of the adjustable handle 16. Accordingly, issues associated with wear and tear between joints of the adjustable handle 16 due to the force of water pressure in an interior of the handle are avoided.

Furthermore, by providing a connection to the water conduit 12 at showerhead 14, issues associated with water pressure within a telescoping shower handle are avoided. That is, if water conduit 12 were coupled to the end of adjustable handle 16 closest to shower pipe 13, water pressure within the adjustable handle 16 would need to be maintained by providing multiple water-tight seals between overlapping portions of the adjustable handle, showerhead and water conduit and the adjustable handle would need to be locked into place before pressurizing the assembly in order to avoid the assembly from extending to its maximum distance due to the internal water pressure differential.

In alternative configurations, conduit 12 may be coupled at one end to a bath tub faucet or a shower pipe via a bracket (shown in FIG. 22) and at a second end to showerhead 14. However, in each of the above-described configurations, water conduit 12 transports water from the shower pipe 13, through an overall length of the adjustable handle 16, and to the showerhead 14, where a water-tight connection is formed between water conduit 12 and showerhead 14.

Water conduit 12 is a flexible hose, preferably made of nylon-reinforced PVC, and has first and second opposing ends 18, 20. The first end 18 attaches to a standard shower pipe 13 extending from the wall of the shower stall via shower-pipe-connector nut 21. The second end 20 couples to the showerhead 14 via connecting structure 22. Between its connection points, water conduit 12 extends through adjustable handle 16 where more or less of water conduit 12 is housed within adjustable handle 16 depending on the position of adjustable handle 16.

Showerhead 14 receives water from the water conduit 12 and disperses water in a spray pattern at a spray angle that may be adjusted, according to certain embodiments of the invention. The showerhead 14 includes a receiving portion 24 (FIG. 3) and a fluid dispersing portion 26 (FIG. 2). Using the connection structure 22, the water conduit 12 is attached to the receiving portion 24, such that the receiving portion 24 receives water from the water conduit 12. As water is received in the showerhead 14, the water flows out of the fluid dispersing portion 26 in a spray pattern at a first spray angle. Showerhead 14 may include any conventional showerhead that is used in conjunction with a conventional handheld shower assembly.

Figure 4:
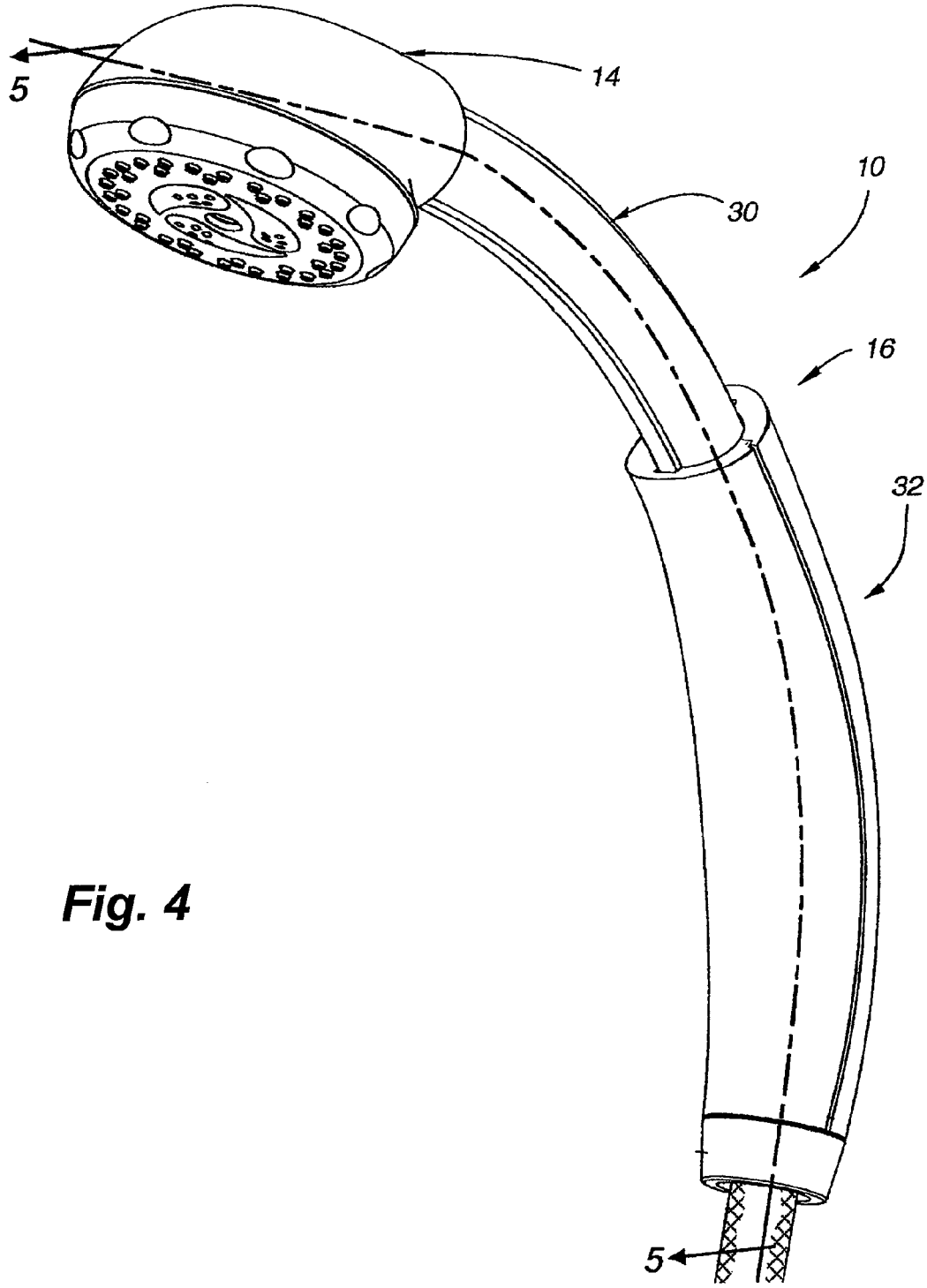
FIG. 4 is a perspective view of the handheld shower assembly of FIG. 1 with the adjustable handle shown in a second position, in accordance with the exemplary embodiment of the present invention.
Figure 5:
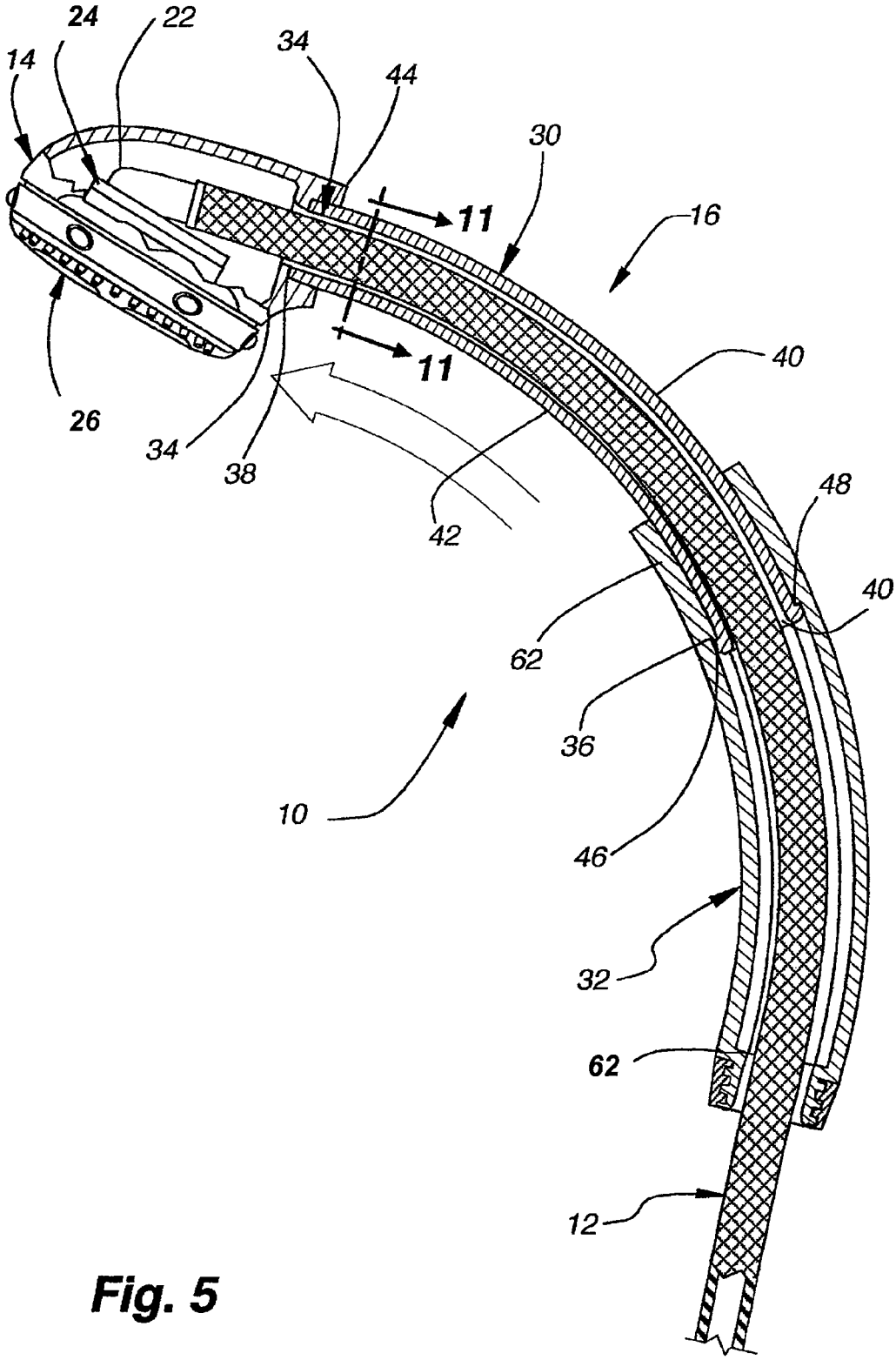
FIG. 5 is a cross-sectional view of the handheld shower assembly with the handle in the second position taken along lines 5-5 of FIG. 4.

Adjustable handle 16, as depicted in FIGS. 4 and 5, may occupy a second or extended position. The adjustable handle 16 includes a first, or upper, handle member 30 and a second, or lower, handle member 32. The upper handle member 30 is coupled to the lower handle member 32 at a first end, such that the upper handle member 30 slides within the lower handle member 32 to adjust the overall length of the adjustable handle 16. For example, and as described in more detail below, the adjustable handle 16 may occupy a fully retracted position (as shown in FIG. 1), a fully extended position (as shown in FIG. 4), or one or more intermediate positions. Alternatively, the lower handle member 32 may be configured to slide within the upper handle member 30 instead of the upper handle member 30 sliding within the lower handle member 32.

According to certain implementations, and as shown in FIGS. 4 and 5, showerhead 14 is fixedly secured to upper handle member 30 so that the position of showerhead 14 relative to upper handle member 30 may not be altered. In further implementations, showerhead 14 may be rotatably secured to upper handle member 30 so that showerhead 14 can be moved about a single axis of rotation relative to upper handle member 30. Showerhead 14 may also be pivotable relative to the end of upper handle member 30, allowing for angular adjustment of showerhead 14 such that fluid dispersing portion 26 may deliver water in a spray pattern at a number of spray angles.

According to one implementation, upper handle member 30 may be contoured to a cylindrical shape having a longitudinal axis. More specifically, the upper handle member 30 may form a curvilinear cylindrical shape. Alternatively, the upper handle member 30 may form a linear cylindrical shape. The shape of the upper handle member 30 is configured to aid in producing a desired spray angle of the water dispersed by the showerhead 14. For example, if the adjustable handle 16 comprises the curvilinear cylindrical shape and the adjustable handle 16 occupies the retracted position, e.g., upper handle member 30 is arranged in the interior of lower handle member 32, the showerhead 14 emits the water at a first, or side, angle (FIG. 1). After repositioning the upper handle member 30 from the retracted position to the extended position, the spray angle of the showerhead 14 is also repositioned from the first angle to a second, or overhead, angle (FIG. 4). In addition, when upper handle member 30 is situated in-between the retracted and extended position, the spray angle of the showerhead 14 may deliver water at one of various angles between the first and second, overhead angle. The upper handle member 30 may be made of a metallic material. Alternatively, the upper handle member 30 may be made of a polymeric material.

Figures 6, 7:
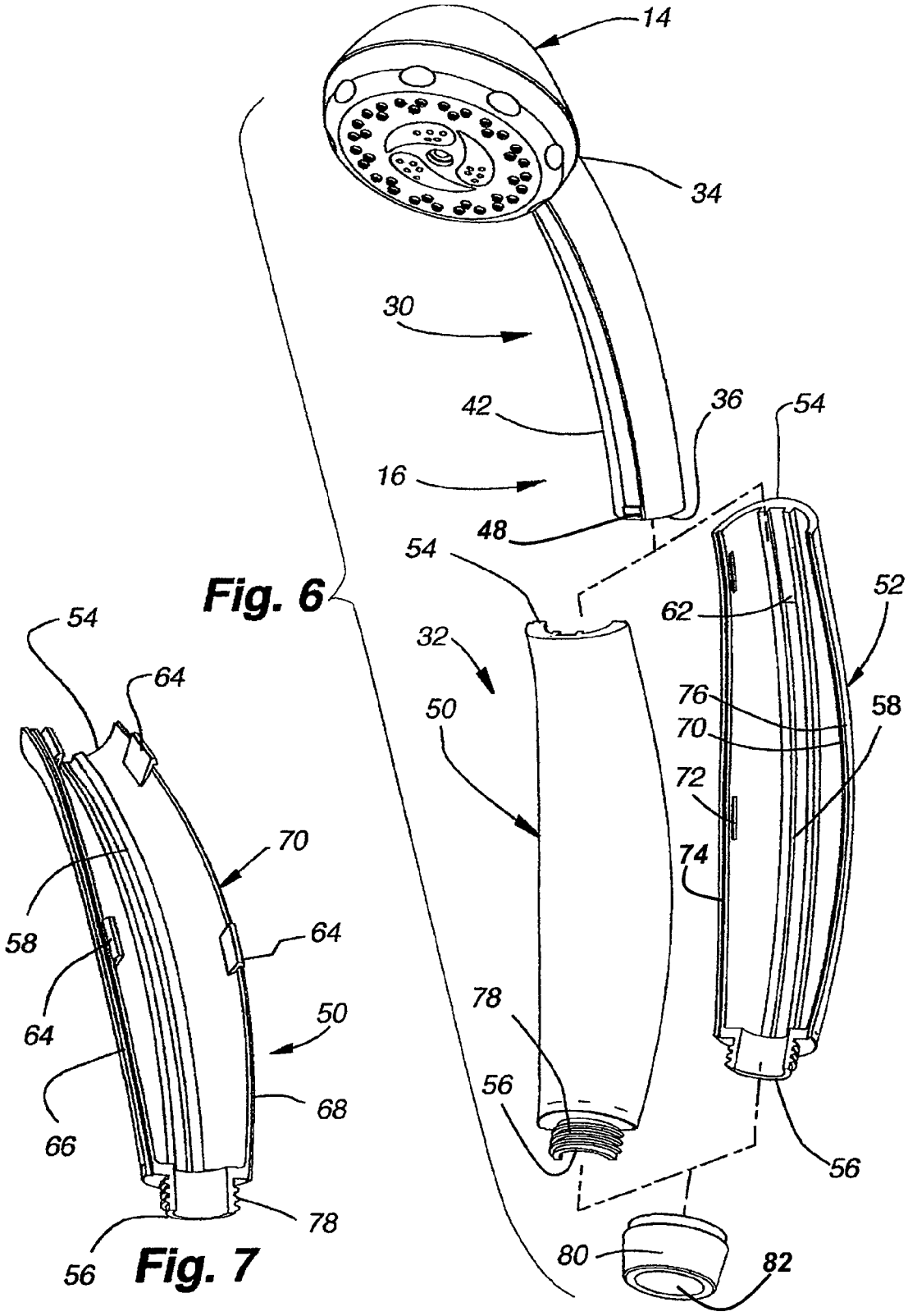
FIG. 6 is a partially exploded view of the handheld shower assembly.
FIG. 7 is a perspective view of a first half of a lower member of the adjustable handle.
Figure 8:
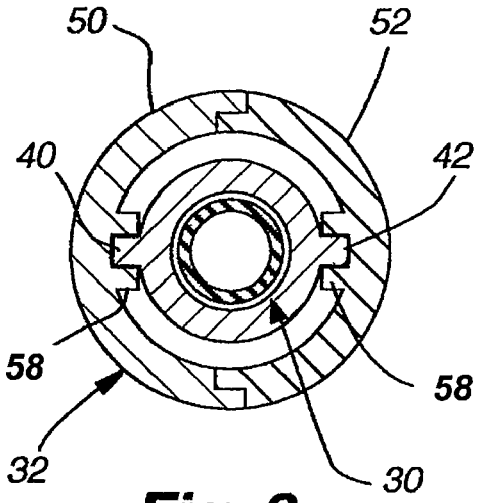
FIG. 8 is a cross-sectional view of the handle taken along lines 8-8 of FIG. 2.
Figure 10:
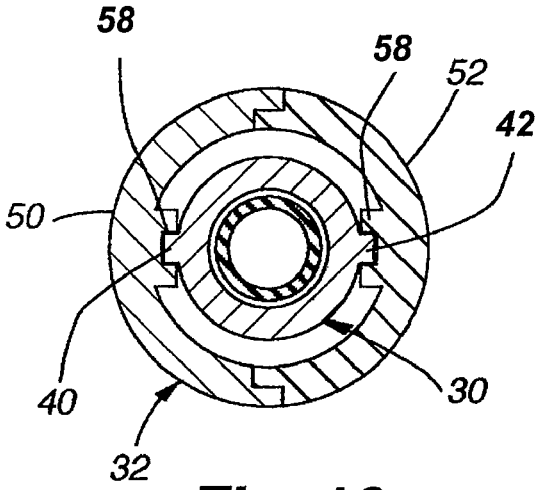
FIG. 10 is a cross-sectional view of the handle taken along lines 10-10 of FIG. 2.
Figure 9:
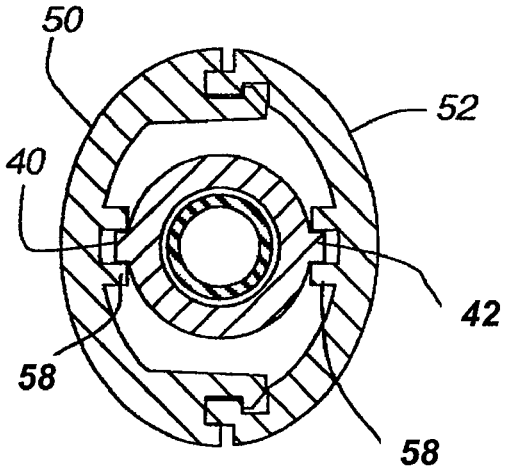
FIG. 9 is a cross-sectional view of the handle taken along lines 9-9 of FIG. 2.

As best shown in FIGS. 5-6, the lower handle member 32 is conformed to a cylindrical body having a longitudinal axis. The cylindrical body includes a curvilinear shape. Alternatively, the cylindrical body may include a linear shape. As previously mentioned, the shape of the upper handle member 30 aids in providing the spray angle of the water dispersed from the showerhead 14. Likewise, the lower handle member 32 also aids in repositioning the spray angle of the water by the showerhead 14.

Accordingly, in certain implementations, the upper and lower handle members 30, 32 may be contoured to the same or similar shapes. Alternatively, the upper and lower handle members 30, 32 may be configured to have different shapes. When the upper handle member 30 and the lower handle member 32 comprise a curvilinear shape, the upper handle member 30 telescopes from the extended position (FIG. 4) to the retracted position (FIG. 1), or vice versa along a curved trajectory. This allows the showerhead 14 to change the spray angle of the water emanating from the showerhead 14. For example, if the upper handle member 30 telescopes from the retracted position to the extended position, the spray angle may change the water flow from a side angle to an overhead angle.

In FIG. 5, the upper handle member 30 includes an opposing first end 34 and second end 36. The first end 34 includes an aperture 38 that extends a length of the upper handle member 30 to the second end 36 forming a hollow chamber 40. The hollow chamber is sized to house the water conduit 12 within the upper handle member 30. The first end 34 is coupled to the showerhead 14. The second end 36 of the upper handle member 30 is coupled to the lower handle member 32.

Figure 11:
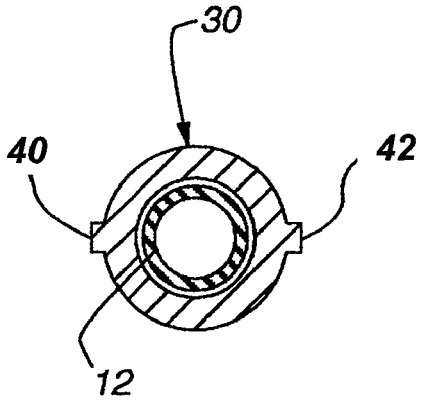
FIG. 11 is a cross-sectional view of an upper member of the handle taken along lines 11-11 of FIG. 5.

As best shown in FIGS. 5 and 11, the upper handle member 30 may also include a first guiding track 40 and a second guiding track 42. The tracks 40, 42 are located on a surface of the upper handle member 30 along a longitudinal axis. Additionally, the tracks 40, 42 are parallel and located on opposing sides of the upper handle member 30. Each track 40, 42 includes a first end 44 and a second end 46. In FIG. 5, tracks 40, 42 follow the contour of upper handle member 30, and at the second end 46, tracks 40, 42 include a stepped, wedged, or notched surface 48. Alternatively, the second end 46 may include a stepped or wedged ring. The functionality of the notched surface 48 in relation to the lower handle member 32 will be further described in the discussion of FIGS. 6-7.

In FIGS. 6-7, lower handle member 32 includes a first half 50 and a second half 52, each with an opposing first end 54 and second end 56. The receiving track 58 of the first half 50 and second half 52 are on interior surfaces of lower handle member 32. As the upper handle member 30 is telescoped within the lower handle member 32, this interconnection between the receiving tracks 58 and the guiding tracks 40, 42 allows the upper handle member 30 to slide relative to the lower handle member 32 along a predetermined path. According to certain embodiments, receiving track 58 may be configured with a complementary shape relative to its respective guiding track 40, 42.

At the first end 54 of first and second halves 50, 52, each receiving track 58 includes a ledge, or wedge, portion 62 that extends from an inner surface of the first and second halves 50, 52. As the upper handle member 30 is slid from the retracted position to the extended position, or vice versa, the guiding tracks 40, 42 travel along the receiving tracks 58 until the notched surface 48 abuts against the ledge portion 62. The ledge portion 62 restricts the travel of the upper handle member 30 and prevents the upper handle member from decoupling from the lower handle member 32.

According to FIGS. 6-7, the interior of the first half 50 of lower handle member 32 includes a plurality of clips 64. Clips 64 are disposed on longitudinal edges 66, 68 of the first half 50. In FIGS. 6 and 7, the first half 50 is approximately half-circular in lateral cross-section and the clips 64 are formed at opposing edges of the half-circle shape. One pair of clips 64 are formed at the first end 54 of the first half 50 and another pair 64 at a mid-portion 70 of the first half 50. In other implementations, the shape of first half 50 and the location and/or shape of the clips 64 may vary.

The interior of the second half 52 of lower handle member 32 includes a set of complementary recesses 72 disposed on longitudinal edges 74, 76. In FIGS. 6 and 7, the second half 52 is approximately half-circular in lateral cross-section and the recesses 72 are formed at opposing edges of the half-circle shape. One pair of recesses 72 is formed at or near the first end 52 and another pair of the recesses 72 are formed at or near the mid-portion 70 of the second half 52. In an alternative embodiment, the shape of the second half 52 and the location and/or shape of the recesses 72 may vary. When the first half 50 and the second half 52 are combined, the clips 64 are inserted into the recesses 72 to secure the first half 50 to the second half 52. Alternatively, the first half 50 and the second half 52 may be combined to form the lower handle member 32 using adhesive, thermal bond, sonic weld, or at least one clamp or fastener.

The second end 56 of first half 50 and second half 52 includes a threaded portion 78. The threaded portion 78 is configured to receive a threaded connecting nut 80 in order to further secure the first half 50 to the second half 52. Additionally, a portion of the water conduit 12 extends through an aperture 82 of the nut 80.

Referring to FIGS. 8-11, cross-sectional views of the handheld assembly 10 are disclosed wherein each of the first and second halves 50, 52 includes a receiving track 58 to receive a corresponding guiding track 40, 42 of the upper handle member 30. In particular, FIGS. 8-10 disclose cross sectional views of the handle 16, thereby illustrating the interconnection of the receiving tracks 58 and the guiding tracks 40, 42. This interconnection may prevent the upper handle member 30 from twisting or rotating along a non-longitudinal axis. In addition, receiving tracks 58 and guiding tracks 40, 42 are configured such that a friction lock is formed between upper and lower handle member when adjustable handle member 16 is set to a desired position. As a result, upper handle member 30 and lower handle member 32 remain in the desired position until a user alters their relative position. Further, from FIGS. 8-10, the shape of lower handle portion 32 first and second half 50, 52 changes from a cylindrical tube shape (FIG. 8) to an oblong shape (FIG. 9) and back to a cylindrical tube shape (FIG. 10), which may provide a user with a surface that is easy to hold and contoured for the user's hand when gripping the handheld assembly. It will be understood, however, that the exterior surface of first and second half 50, 52 may be configured with any suitable shape, and may include features such as ridges, relief spots, finger and thumb impressions, or other tactile items.

Figure 12:
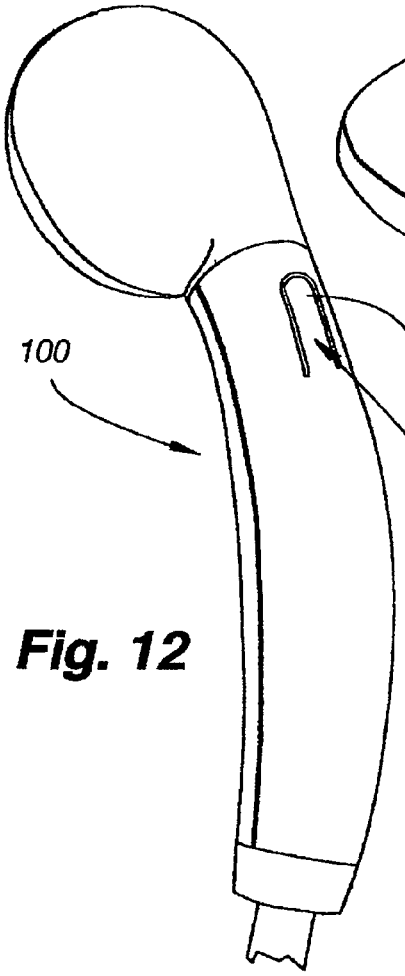
FIG. 12 is perspective view of the adjustable handle of FIG. 1 having a first embodiment of a locking mechanism with the handle shown in the first position.
Figure 13:
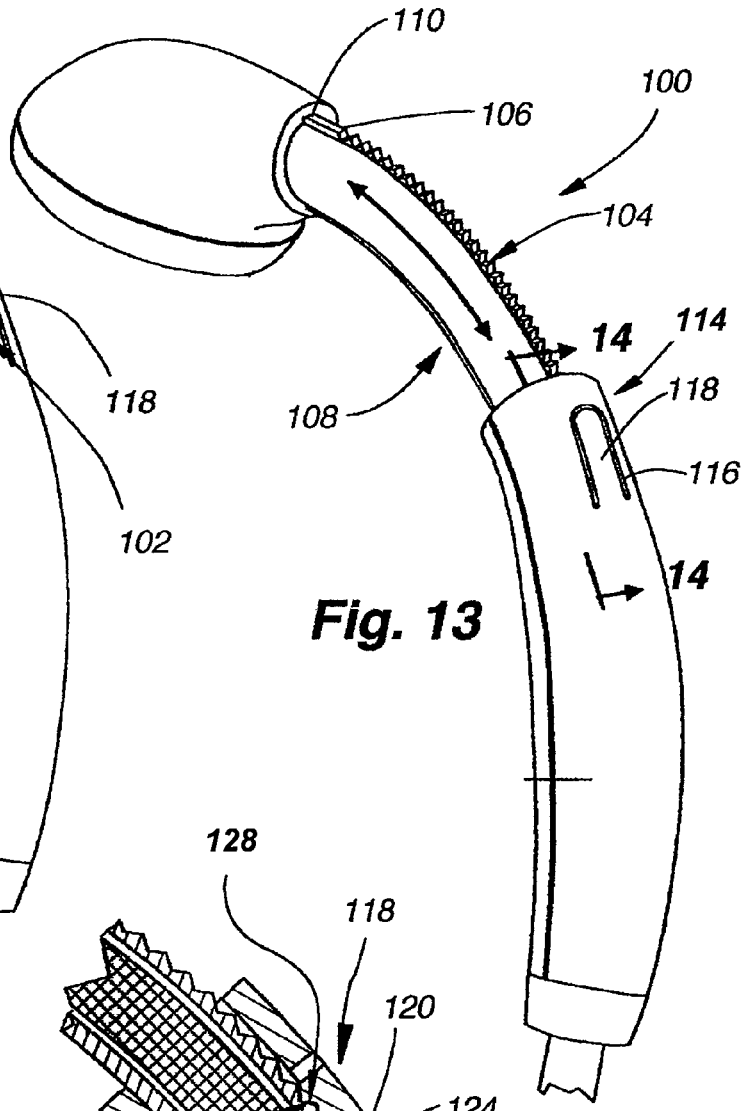
FIG. 13 is a perspective view of the adjustable handle having the first locking mechanism with the handle shown in the second position.

FIG. 12 provides an illustration of a perspective view of another embodiment of a handheld shower assembly that includes an exemplary locking mechanism. In FIG. 12, handheld shower assembly 100 is a fixed incremental locking mechanism 102 shown in the retracted position. In the extended position, as seen in FIG. 13, the locking mechanism 102 includes guiding track 106 configured as a tooth track 104 and a latching lock 118 configured to engage the tooth track 104. The tooth tracks 104 extend from a first end 110 of the guiding tracks 106 to a notched surface 112 that is used to prevent the upper handle member 108 from disconnecting from a lower handle member 114.

The lower handle member 114 includes an opening 116 forming a U-shaped pattern, and the area formed by the boundaries of the U-shaped pattern defines the latching lock 118. The latching lock 118 has a first material thickness 120 and a second material thickness 122. A portion of latching lock 118 corresponding to the first material thickness 120 forms a ledge portion 124, and is thicker than the portion of latching lock 118 corresponding to the second material thickness 122 located at an inner surface 126 of the lower handle member 114. In the thinner area of the second material thickness 122, latching lock 118 is elastically flexible as the upper handle member 108 is telescoped relative to the lower handle member 114. In the thicker area of the first material thickness 120, latching lock 118 includes a keyed feature 128 configured to have a structure that is complementary and engageable with teeth 130 of tooth track 104.

Figure 14:
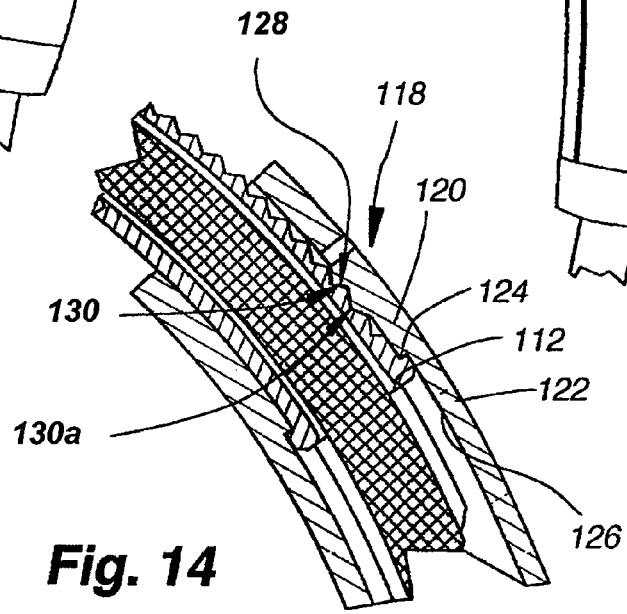
FIG. 14 is a partial cross-sectional view of the adjustable handle having the first locking mechanism with the handle shown in the second position taken along lines 14-14 of FIG. 13.

In FIG. 14, the partial cross-sectional view of handheld shower assembly 100 in the extended position is taken along lines 14-14 of FIG. 13 and depicts latching lock 118 with a keyed feature 128. The keyed feature 128, configured complementary to the tooth track 104, engages and disengages each tooth 130 along the tooth track 104 as the upper handle member 108 is telescoped within the lower handle member 114 from one position to another position, e.g., collapsed to extended position or partially extended to collapsed position. In operation, a user grips the showerhead proximate first end 110 of guiding tracks with one hand and grips the lower handle member 114 with the other and pulls or pushes the two portions apart or together. Once upper handle member 108 is in a desirable position, the user releases the showerhead, and the keyed feature 128 remains engaged with a particular tooth 130*a* of the tooth track 104 to secure the upper handle member 108 relative to the lower handle member 114 in the desired position.

Figure 15:
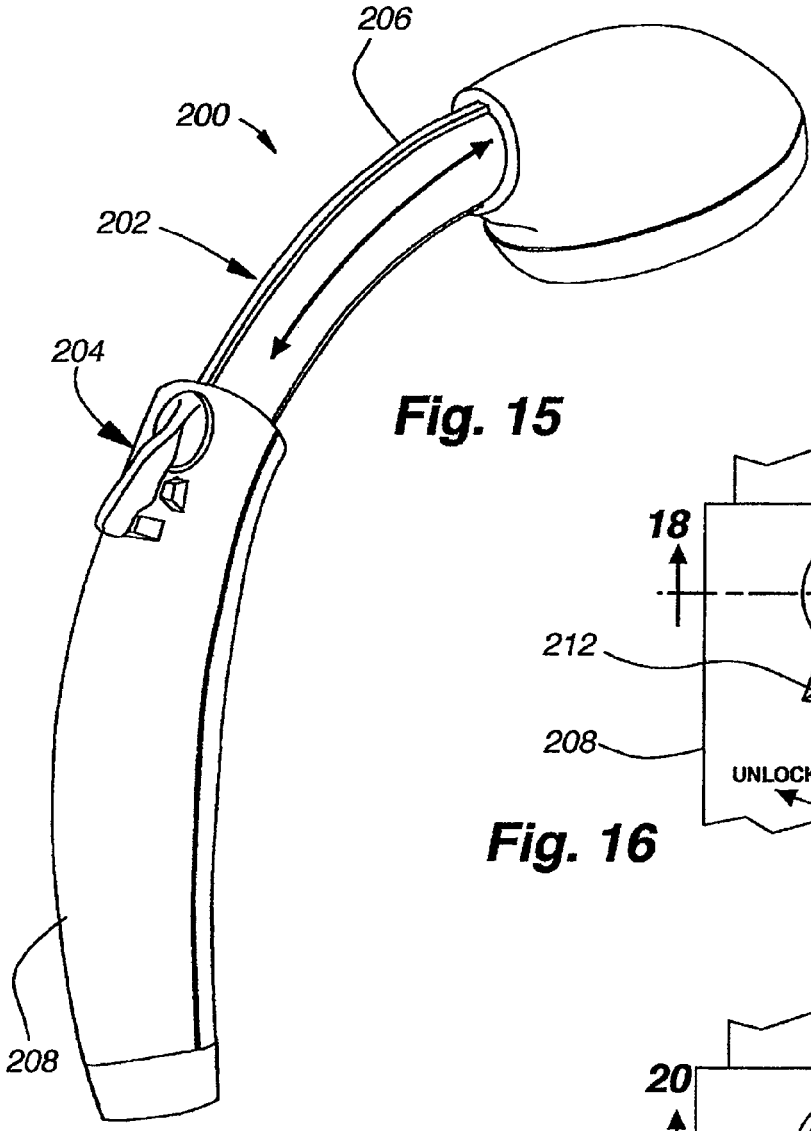
FIG. 15 is a perspective view of the adjustable handle having a second embodiment of a locking mechanism with the handle shown in the second position.

FIG. 15 depicts a third exemplary embodiment of the handheld shower assembly having another exemplary locking mechanism. In FIG. 15, the handheld shower assembly 200 includes an adjustable handle 202 in an extended position. Coupled to the adjustable handle 202 is a variable adjusting locking mechanism 204 disposed on lower handle member 208 that is rotatable to a locked and unlocked position. The locking mechanism 204 is configured to allow the upper handle member 206 to be variably adjusted relative to the lower handle member 208 when transitioning from one position to another position.

Figure 16:
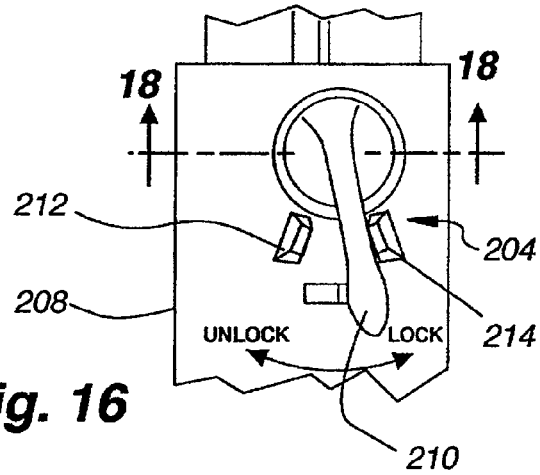
FIG. 16 is a perspective view of the second embodiment of the locking mechanism of FIG. 15 in a locked position.
Figure 17:
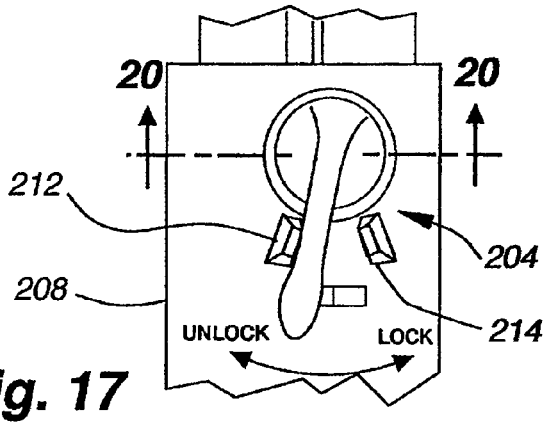
FIG. 17 is a perspective view of the second embodiment of the locking mechanism of FIG. 15 in an unlocked position.

According to FIGS. 16 and 17, the locking mechanism 204 includes a lever 210 configured to switch between a first or locked position and a second or unlocked position. The locking mechanism 204 also may include a first stopper block 212 and a second stopper block 214 located on opposite sides of the lever 210. The stopper blocks 212, 214 prevent the lever 210 from rotating beyond a locking or unlocking position and provide a visual indicator to a user when the lever 210 has locked or unlocked the upper handle member 206 for adjusting the overall length of the handle 202. If the lever 210 is switched to the locked position (FIG. 16), the upper handle member 206 is locked or secured in the desired position. On the other hand, if the lever 210 is switched in the unlocked position (FIG. 17), the upper handle member 206 is capable of telescoping relative to the lower handle member 208 in order to modify the overall length of the adjustable handle 202. Further, when the lever 210 is in the unlocked position, a user may freely move upper handle member 206 relative to the lower handle member 208 to any desired length, e.g., any length between a collapsed position, like in FIG. 1, to a fully extended position, like in FIG. 15. Accordingly, when lever 210 is in the unlocked position, handheld shower assembly 200 is operable in a substantially similar manner as handheld shower assembly 10.

Figure 18:
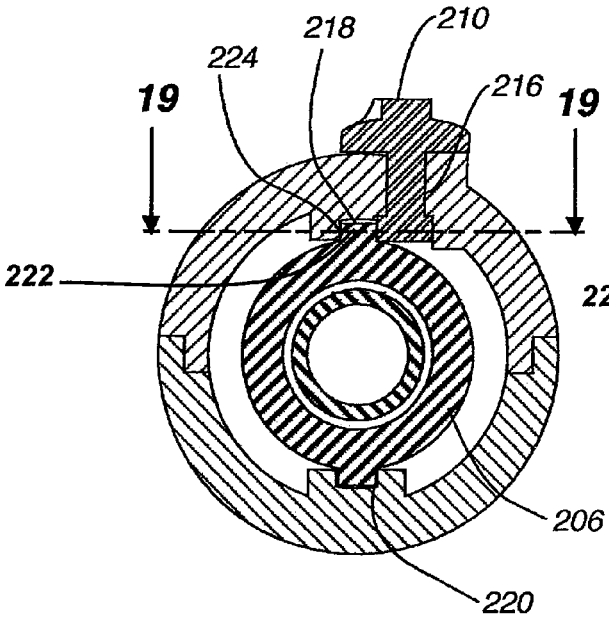
FIG. 18 is a cross-sectional view of the handle having the locking mechanism in the locked position taken along lines 18-18 of FIG. 16.
Figure 19:
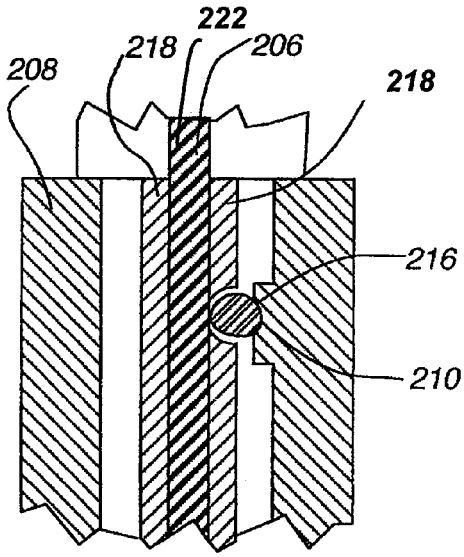
FIG. 19 is a cross-sectional view of the handle having the locking mechanism taken along lines 19-19 of FIG. 18.

FIGS. 18-19 illustrate cross-sectional views of the adjustable handle 202 with a key 216 of the locking mechanism 204 in the locked position. A receiving track 218 is wider than a second receiving track 220. The receiving track 218 is configured to receive the key 216 and a guiding track 222 of the upper handle member 206, wherein the key 216 abuts against the guiding track 222, securing guiding track between key 216 and adjoining wall 224. This action causes the key 216 to secure and restrict movement of the upper handle member 206 relative to the lower handle member 208.

Figure 20:
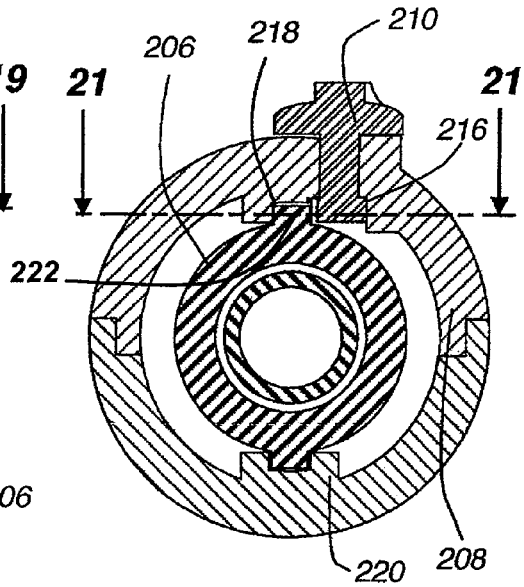
FIG. 20 is a cross-sectional view of the handle having the locking mechanism in the unlocked position taken along lines 20-20 of FIG. 17.
Figure 21:
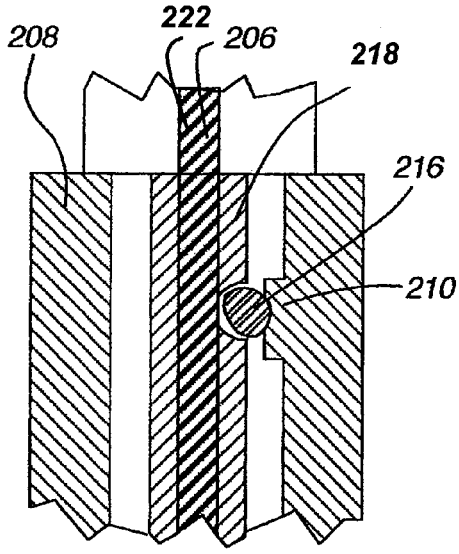
FIG. 21 is a cross-sectional view of the handle having the locking mechanism taken along lines 21-21 of FIG. 20.

As best shown in FIGS. 20-21, cross-sectional views of the adjustable handle 202 having the key 216 in the unlocked position. When the lever 210 is switched to the unlocked position, the key 216 releases the guiding track 222. This allows the upper handle member 206 to telescope relative to the lower handle member 208 in order to adjust the overall length of the adjustable handle 202.

It will be understood that locking mechanisms including those described above may be located on any portion of handheld shower assembly 10. For example, a locking mechanism may be located at the top, middle or bottom of lower handle member 32, either at a front or back side, e.g., at either first half 50 or second half 52. When a locking mechanism is partially arranged at a second end 56 of the lower handle member 32, a lever or pulley system (not shown) may be employed in order to release and secure an engagement with the upper handle 30 member near the first end 54 of the lower handle member 32. As a result, nearly the entire length of upper handle member 30 may be extended from lower handle member even when a portion of the locking mechanism is located at a second end of the lower handle member 32.

Figure 22:
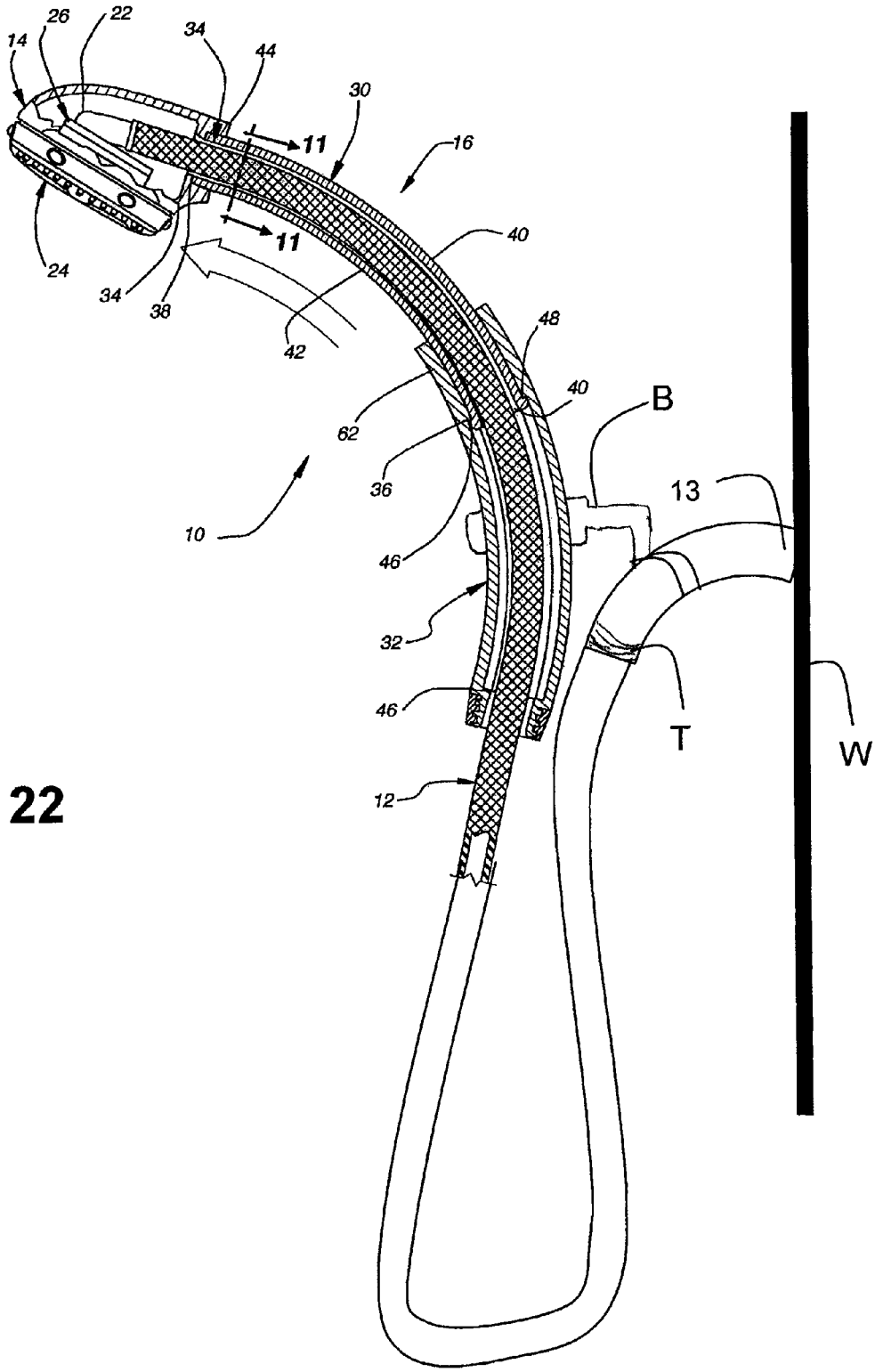
FIG. 22 is a cross-sectional view of the handheld shower assembly and a bracket arrangement with the handle in the second position taken along lines 5-5 of FIG. 4.

FIG. 22 is a cross-sectional view of the handheld shower assembly 10 and a bracket arrangement B with the handle in the second position taken along lines 5-5 of FIG. 4. In FIG. 22, bracket arrangement B is coupled at one end to shower pipe 13 extending from wall W and at another end to shower assembly 10 at lower handle member 32. In alternative configurations, bracket arrangement B may be coupled to wall W, to threading T of shower pipe 13, or to water conduit 12, for example, in an area proximate shower pipe 13. In use, bracket arrangement B holds shower assembly at an angle that facilitates delivering spray to a user. As shower assembly 10 is moved from a first to a second position, or vice versa, the spray angle delivered to the user changes. For example, moving shower assembly 10 outward and forward to the second angle as shown in FIG. 22 results in water delivery at an overhead angle. Alternatively, shower assembly 10 may be moved inward and backward to its first position as shown in FIG. 1 in order to deliver water at a side spray delivery angle.

The invention described herein provides a novel handheld shower assembly. The shower assembly includes an adjustable handle having an upper member and a lower member. Adjustably attached to one another, the upper member telescopes relative to the lower member. This allows a user the ability to manipulate and adjust an overall length of the adjustable handle along with the spray angle of the fluid dispensing portion. Although an upper and lower handle member have been described herein, additional handle members, e.g., a third, fourth or fifth handle member is contemplated. For example, a third or intermediate handle member may be disposed between the upper and lower handle member allowing for additional telescoping and thus angular adjustment of the spray angle from the fluid dispensing portion. In a further embodiment, a third or intermediate handle member may be lockable via a locking mechanism.

The ability to adjust the spray angle of the handheld shower assembly provides certain advantages for a user. For example, some individuals have limited range of motion in their arms and are unable to raise their arm to a height that allows the use of a traditional handheld shower. Furthermore, some users may engage in bathing a child or an elderly person and may find reaching areas of the body difficult using a traditional handheld shower. The additional length provided by the handheld shower assembly of the present invention may provide such a user with the distance needed to effectively wash more distant areas of their or another's body, e.g. the back. Furthermore, the angular adjustment provided by extending and retracting the handheld shower assembly allows a the assembly to be held in a bracket or in a user's hand at one angle while delivering water at a various spray angles.

Although the present invention has been described with reference to preferred embodiments, persons skilled in the art will recognize that changes may be made in form and detail without departing from the spirit and scope of the invention.

What is claimed is:

1. A handheld shower assembly comprising a handle having a first portion comprising a first curvilinear body; and a second portion comprising a second curvilinear body, wherein the first portion is slidably attached to the second portion;

the first portion is operative to move between at least a first position in a range of positions to a second position in the range of positions coaxially with respect to the second portion;

the first portion extends along a range of lengths outwardly from the second portion when in the first position and retracts at least partly within the second portion relative to the first position when in the second position; and the handle holds a curvilinear shape when the first portion and the second portion are in the first position and when the first portion and the second portion are in the second position; and a showerhead coupled to the handle configured to distribute water; and a hose adapted to receive and transport water from a water source to the showerhead, the hose extending through an interior of the handle and directly coupling to the showerhead.

2. The handheld shower assembly of claim 1, wherein the showerhead is coupled to the first portion of the handle.

3. The handheld shower assembly of claim 1, wherein when the first portion is in the first position, the showerhead is arranged relative to the second portion at a first angle, and wherein when the first portion is in the second position, the showerhead is arranged relative to the second portion at a second angle different from the first angle.

4. The handheld shower assembly of claim 3, wherein the first angle comprises an angle for delivering an overhead shower spray angle when the handheld shower assembly is placed in a mount on a wall.

5. The handheld shower assembly of claim 3, wherein the second angle comprises an angle for delivering a side spray angle when held in the hand of a user.

6. The handheld shower assembly of claim 1, wherein the handle further comprises a locking mechanism to secure the first portion relative to the second portion in the second position.

7. The handheld shower assembly of claim 6, wherein the locking mechanism is configured to allow the first portion to variably adjust relative to the second portion from the first position to the second position.

8. The handheld shower assembly of claim 6, wherein the locking mechanism is configured to allow the first portion to adjust relative to the second portion in fixed incremental steps when transitioning from the first position to the second position.

9. The handheld shower assembly of claim 1, wherein the showerhead further comprises a connection structure that allows the hose to directly couple within the showerhead substantially perpendicular to a back wall of a fluid dispersion portion.

10. A method of manufacturing a handheld shower assembly comprising coupling a first handle portion having a first curvilinear body to a second handle portion having a second curvilinear body to form an adjustable handle, wherein the first handle portion is operative to slide between at least a first position to a second position with respect to the second handle portion, the first handle portion extending at least a partly outwardly from the second handle portion when in the first position and retracted at least partly within the second handle portion relative to the first position when in the second position, wherein the handle maintains a curved form whether in the first position or the second position;

extending a hose for receiving and transporting water from a water source through the adjustable handle;

directly coupling the hose to a showerhead; and coupling the showerhead to the first handle portion.

11. The method of claim 10, wherein coupling the first portion and the second portion further comprises coupling a locking mechanism between the first portion and the second portion to variably secure the first portion relative to the second portion in the first position and the second position.

12. The method of claim 11, wherein coupling the locking mechanism further comprises configuring the locking mechanism to allow the first portion to variably adjust with respect to the second portion and secure a variable length of the handle when transiting from the first position to the second position.

13. The method of claim 11, wherein coupling the locking mechanism further comprises configuring the locking mechanism between the first portion and the second portion to adjust and secure the first portion relative to the second portion in fixed incremental adjustments.

14. The method of claim 10, wherein coupling the first portion and the second portion further comprises coupling the first portion and the second portion such that when the first portion slides between the first position and the second position, an overall length of the handle is modified.

15. The method of claim 10, wherein coupling the first portion and the second portion further comprises coupling the first portion to the second portion such that when the first portion slides between the first position and the second position, water dispersed by the showerhead changes from a first spray angle to a second spray angle with respect to the second portion.

16. The method of claim 10, wherein directly coupling the hose to the showerhead further comprises using a connection structure to directly couple the hose substantially perpendicular to a back wall of a fluid dispersion portion within the showerhead.

* * * * *